US011737544B2

(12) United States Patent
Delia et al.

(10) Patent No.: US 11,737,544 B2
(45) Date of Patent: Aug. 29, 2023

(54) CONTAINER FOR DISPENSING LOOSE POWDER AND METHOD OF FILLING THE CONTAINER

(71) Applicant: Toly Management Ltd., Zejtun (MT)

(72) Inventors: Mario Delia, Zabbar (MT); James Attard Kingswell, St. Julians (MT); Phillippe Parker, Hal Attard (MT); Brian McNamara, Mosta (MT); Matthew Brincat, Pembroke (MT)

(73) Assignee: Toly Management Ltd., Zejtun (MT)

( * ) Notice: Subject to any disclaimer, the term of this patent is extended or adjusted under 35 U.S.C. 154(b) by 643 days.

(21) Appl. No.: 16/828,568

(22) Filed: Mar. 24, 2020

(65) Prior Publication Data

US 2020/0397115 A1 Dec. 24, 2020

Related U.S. Application Data

(60) Provisional application No. 62/864,625, filed on Jun. 21, 2019.

(51) Int. Cl.
*A45D 33/02* (2006.01)
*A45D 33/22* (2006.01)
(Continued)

(52) U.S. Cl.
CPC ..... *A45D 33/025* (2013.01); *A45D 33/003* (2013.01); *A45D 33/22* (2013.01);
(Continued)

(58) Field of Classification Search
CPC .. A45D 2200/25; A45D 33/22; A45D 33/003; A45D 33/025; A45D 33/02–16
(Continued)

(56) References Cited

U.S. PATENT DOCUMENTS 1,624,874 A * 4/1927 Radley ..... A45D 33/006 132/298
1,635,326 A * 7/1927 Kasdan ..... A45D 33/006 132/298
(Continued)

FOREIGN PATENT DOCUMENTS

FR 2925295 6/2009
WO 2009/010701 1/2009

OTHER PUBLICATIONS

French Search Report for FR 2006300 dated Dec. 8, 2022.

*Primary Examiner* — Patrick M. Buechner
(74) *Attorney, Agent, or Firm* — Wissing Miller LLP

(57) ABSTRACT

A container for loose powder, having a well defining a well volume, a side wall surrounding the well laterally to define an upwardly closed powder chamber extending circumferentially around the well, and a bottom member cooperating with the well and the side wall to close the lower ends of the well volume and the chamber. The bottom member and at least a part of the well are relatively rotatable between positions in which the well and bottom member cooperatively prevent passage of powder from the chamber to the well volume, and in which at least one gap opens to permit limited passage of powder from the chamber into the lower end of the well volume. A lid closing the well volume is removable to enable an applicator to transport powder from the well volume to a location outside the container.

7 Claims, 17 Drawing Sheets

(51) Int. Cl.
*B05B 11/00* (2023.01)
*A45D 33/00* (2006.01)

(52) U.S. Cl.
CPC ..... *B05B 11/0037* (2013.01); *B05B 11/0097* (2013.01); *A45D 2200/25* (2013.01)

(58) Field of Classification Search
USPC ..... 132/298, 299
See application file for complete search history.

(56) References Cited

U.S. PATENT DOCUMENTS 1,644,377 A * 10/1927 Heilbron ..... A45D 33/025 132/298
1,855,399 A * 4/1932 Klotz ..... A45D 33/006 132/298
1,887,333 A * 11/1932 Smith ..... A45D 33/003 132/307
2,342,200 A 12/1941 Johnson
2,281,532 A 4/1942 Lewis et al.
2,460,444 A 2/1949 Bering
2,721,009 A 10/1955 Reid
4,446,879 A 5/1984 Gueret
4,605,022 A 8/1986 Gueret
4,705,051 A 11/1987 Bacon et al.
4,974,981 A 12/1990 Bennett
5,603,340 A 2/1997 Gueret
5,873,670 A 2/1999 Spivey et al.
6,138,687 A 10/2000 Sheffler et al.
6,474,346 B1 11/2002 Jang
7,011,098 B2 3/2006 Byun
7,607,441 B2 10/2009 Hrymoc
7,794,168 B2 9/2010 Chang
7,841,349 B2 11/2010 Bennett
8,006,707 B2 8/2011 Thorpe et al.
8,132,578 B2 3/2012 LoPrete
8,839,803 B2 9/2014 Holloway
9,609,933 B2 4/2017 Cefaratti
9,629,437 B2 4/2017 Shen
9,775,421 B2 10/2017 Kim
10,167,133 B2 1/2019 Dumler et al.
2005/0175397 A1 8/2005 Chen
2009/0014086 A1 1/2009 MacMichael et al.
2010/0096411 A1 4/2010 Deans
2010/0236572 A1 9/2010 Guenther et al.
2012/0090637 A1 4/2012 Holloway
2019/0037999 A1 2/2019 Mecca et al.

* cited by examiner 50b
48b
48a
50a
37
18
16
34b
34a
14
22
11
50a
48a
48b
50b 22
14
50a
48a
48b
50b
14
48b
50b
50a
48a
14
22

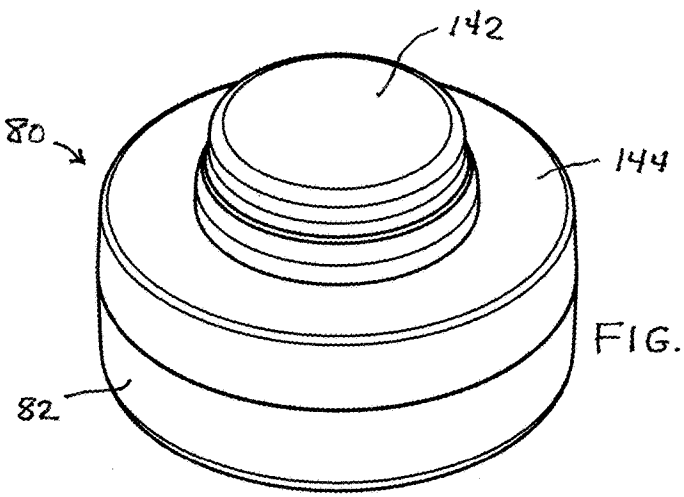
FIG. 17
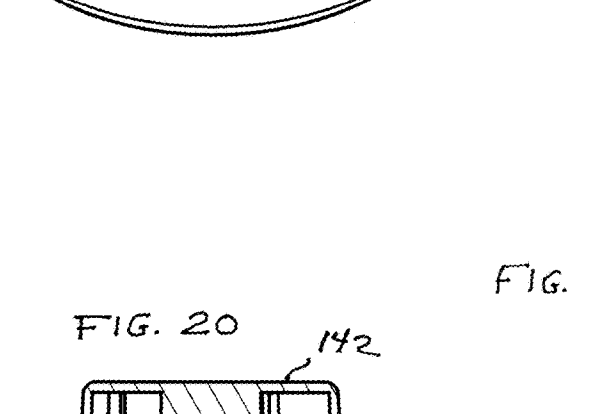
FIG. 18
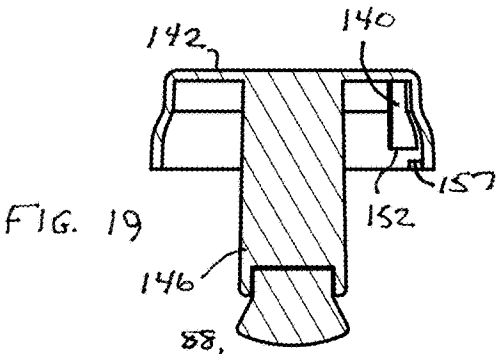
FIG. 19
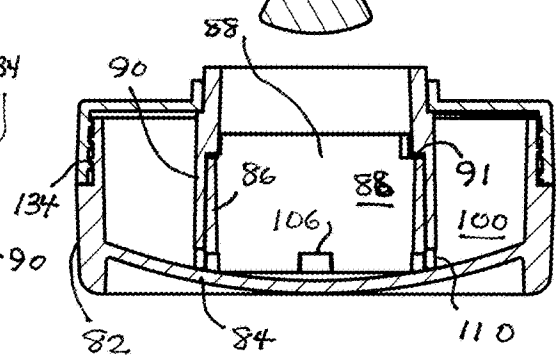
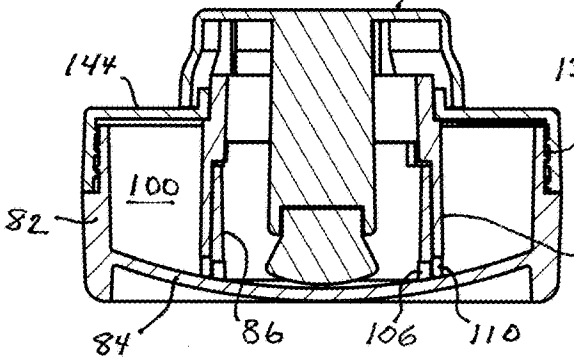
FIG. 20
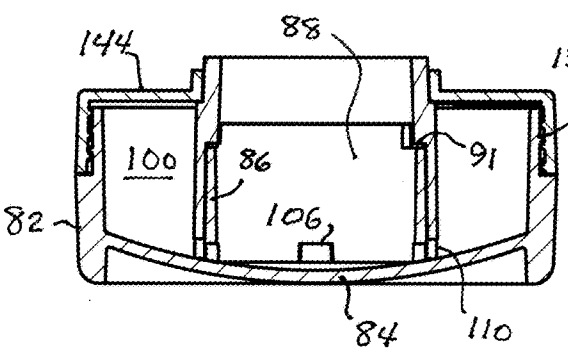

CONTAINER FOR DISPENSING LOOSE POWDER AND METHOD OF FILLING THE CONTAINER

CROSS REFERENCE TO RELATED APPLICATION

This application claims the benefit, under 35 U.S.C. § 119(e), of U.S. provisional patent application No. 62/864,625 filed Jun. 21, 2019, the entire disclosure of which is incorporated herein by this reference.

BACKGROUND OF THE INVENTION

This invention relates to cosmetic containers, and more particularly to containers for holding and dispensing loose powders.

Many powdered cosmetic and skin care products are conveniently packaged, for sale to end users, in compacts of a size appropriate to be carried in a handbag or pocket and to be comfortably held in a user's hand for application of the contents to the skin. Such compacts are generally satisfactory for holding a cake powder cosmetic product, which is pressed into cake form and coheres as a cake in the compact base until a portion of it is rubbed or scraped from the cake by the user, employing an applicator, at a time of desired application to the user's skin.

Some powders, however, are necessarily or preferably always maintained in loose condition. When loose powder is dispensed from a conventional container by a user, an undesirable powder cloud is generated. This problem of dust cloud generation has heretofore been intractable.

SUMMARY OF THE INVENTION

An object of the present disclosure is to provide a container for dispensing loose powders, in particular cosmetic powders, wherein the generation of a powder cloud incident to dispensing powder is significantly reduced or eliminated. Another object of the present disclosure is a cosmetic container that holds and dispenses materials that are supplied as frangible beads. The container is operable to grind the beads to release the material as a powder.

Other objects include providing such a container which is economical in manufacture, simple in structure, and easy both to fill with powder and to employ by a user for dispensing powder.

To these and other ends, the present disclosure broadly contemplates the provision of a container for loose powder, comprising a well defining a central upwardly open well volume having a lower end; a container side wall laterally surrounding the well and defining therewith an upwardly closed powder chamber extending circumferentially around the well and having a lower end; a bottom member disposed at a lower end of the well and powder chamber and cooperating therewith to close the central well volume and the lower end of the powder chamber, wherein the bottom member and at least a portion of the well are relatively rotatable between a first position in which the well and the bottom member cooperatively prevent passage of powder from the powder chamber to the well, and a second position in which at least one gap opens to permit limited passage of powder from the powder chamber into the lower end of the well volume; and an openable (e.g. removable) lid closing the upper end of the well for permitting a manipulable applicator to transport powder from the lower end of the well volume to an application location outside the container. The disclosure also embraces the container holding a quantity of powder.

In certain currently preferred embodiments of the disclosure, the container further comprises a bottom cap in which the bottom member is mounted, the bottom cap being disposed at the lower end of the container side wall with the bottom member facing the lower ends of the well volume and the powder chamber. The bottom cap is threaded on the container side wall such that by relative rotation of the bottom cap and the container side wall the bottom member can be moved back and forth between a first position engaging a lower end of the well to prevent passage of powder from the powder chamber into the well volume and a second position spaced from the lower end of the well sufficiently to define the aforesaid gap therewith. The well and the container side wall are connected together to close an upper end of the powder chamber. Moreover, the bottom cap may be initially separate from the container side wall such that the lower end of the powder chamber is open for filling with powder when the container side wall is inverted; in addition, the bottom cap and the container side wall may bear interfering surfaces permitting initial screwing of the bottom cap to mount the bottom cap on the container side wall at the aforesaid first position but preventing subsequent oppositely directed unscrewing of the bottom cap from the container side wall beyond the aforesaid second position.

In other embodiments of the disclosure, the container side wall, the bottom member, and a first upstanding cylindrical wall of the well are fixedly secured together, and the container further comprises a second cylindrical wall of the well snugly concentric with and rotatable relative to the first upstanding cylindrical wall about a common axis; a top cap (filling cap) closing an upper end of the powder chamber; and a lid rotatably removably mounted on the container (e.g. on the filling cap) for closing and opening an upper end of the well, the first and second cylindrical walls of the well each having at least one opening at or adjacent their lower ends such that rotation of the second cylindrical wall relative to the first cylindrical wall moves the aforesaid at least one opening of the second cylindrical (outer) wall into and out of register with the aforesaid at least one opening of the first cylindrical (inner) wall for opening and closing the gap, and the lid and an upper end portion of the second cylindrical wall having mutually engageable portions such that rotation of the lid on the container in opposite directions rotates the second cylindrical wall to open and close the gap.

In the latter embodiments, the lid may bear an applicator insertable in the well to pick up powder in the lower end of the well volume; and the filling cap may be initially separate from the container side wall to enable the powder chamber to be filled with loose powder from an upper end of the powder chamber and thereafter non-removably secured to the container side wall.

The disclosure in a further aspect embraces methods of filling the container. In embodiments of the container of the disclosure having a threaded bottom cap as described above, the method includes the steps of inverting the container before the bottom cap is mounted thereon such that the lower end of the powder chamber is open and faces upwardly, delivering loose powder into the powder chamber through the upwardly facing open lower end thereof while preventing delivery of loose powder into the well volume, and thereafter threading the bottom cap onto the container side wall until the bottom cap reaches the aforesaid first position. In embodiments of the container of the disclosure having the bottom member, container side wall and a first upstanding cylindrical wall of the well fixedly secured together, the method includes the steps of standing the container upright such that the powder chamber opens upwardly before the top cap is mounted on the container, delivering loose powder downwardly into the upwardly open powder chamber while preventing delivery of loose powder into the well volume, and thereafter non-removably mounting the filling cap on the container side wall.

In other embodiments of the disclosure the container further comprises a filling port through an upper surface of the powder chamber. The port is adapted to admit the powder into the chamber. A plug shaped to close the filling port is provided. According to one aspect a filling funnel is provide that is shaped to engage the filing port and adapted to direct the powder through the port.

According to another embodiment the container comprising a plurality baffles, the baffles each connected with an outer surface of the well and an inner surface of the sidewall. The baffles divide the powder chamber into a plurality of upwardly closed compartments. The container may also comprise a chamber bottom cover extending between the outer surface of the well and the sidewall and engaging bottom edges of the baffles. A plurality of holes may be provided in the chamber bottom cover, with at least one hole corresponding to each compartment so that the compartments are downwardly open through the respective holes. A bottom cap may also be provided in which the bottom member is mounted with the bottom cap disposed at the lower end of the container side wall with the bottom member facing the holes and being threaded on the container side wall such that by relative rotation of the bottom cap and the container side wall the bottom member moves back and forth between a first position engaging the holes to prevent passage of powder from the powder chamber into the well volume and a second position spaced from the holes to provide a passage for the powder from one or more of the chambers into the well volume.

According to another embodiment of the disclosure there is provided a container for dispensing powder from friable beads that comprises a well defining a central upwardly open well volume having a lower end, a container side wall laterally surrounding the well and defining therewith an upwardly closed bead chamber extending circumferentially around the well and having a lower end, the bead chamber adapted to hold one or more of the beads, one or more blades disposed on the side wall and extending into the chamber, and a bottom member disposed at a lower end of the well and bead chamber, rotatably connected with the sidewall, the bottom member comprising one or more protrusions extending partly into the chamber in close proximity to the blades, wherein the blades and protrusions are adapted to at least partially abrade or crush one or more of the beads when the bottom member is rotated with respect to the side wall. According to one aspect, the bead chamber contains one or more beads. The side wall is separated from the bottom member by a gap smaller than the beads to prevent the beads from exiting the chamber. Rotation of the bottom member with respect to the side wall abrades or crushes one or more beads to release the powder. The released powder flows through the gap and into the well. The container side wall may comprise a cylindrical extension and the bottom member may comprise a cylindrical gap adapted to accept insertion of the extension. The extension and the gap may be arranged to allow mutual rotation of the side wall and the bottom member. According to one aspect a ring is formed on one of the extension and the gap and a groove is formed on the other of the extension and the gap. Engagement of the ring and the groove provide a snap fit connection between the side wall and the bottom member.

According to a further aspect the container includes a lid that removably closes the upper end of the well and that can be opened for permitting a manipulable applicator to transport powder from the lower end of the well volume to an application location outside the container. According to a still further aspect the applicator is mounted on an inner surface of the lid.

It will be understood that orientations and directions such as "horizontal," "vertical," "upwardly," "lower," "top" and "bottom" are used with reference to the container when in closed condition with its base resting on a horizontal surface. "Limited passage of powder" means passage of a quantity of powder that is small relative to the capacity of the powder chamber and the depth of the well. "Snugly" means that the first and second cylindrical walls are in close enough contact with each other to effectively prevent passage of loose powder therebetween although they are relatively rotatable.

Further features and advantages of the invention will be apparent from the detailed description hereinafter set forth, together with the accompanying drawings.

BRIEF DESCRIPTION OF THE DRAWINGS

FIG. 17 is a perspective view of the container of FIG. 14 with the filling cap and lid in place;

FIG. 18 is an exploded sectional elevational view of the container of FIG. 14 with the filling cap in open position and the lid separated therefrom;

FIG. 19 is a view similar to FIG. 18 with the filling cap in closed position;

FIG. 20 is a sectional elevational view of the container of FIG. 14 with the lid attached;

DETAILED DESCRIPTION

Figure 2:
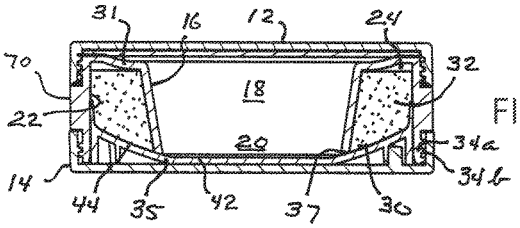
FIGS. 2, 3 and 4 are sectional elevational views of the container of FIG. 1, respectively showing the container fully closed; the lid separated and the main body and bottom cap fully closed; and the lid removed and the main body and bottom cap in powder-dispensing position.

FIGS. 1-13 illustrate the loose powder container of the disclosure as embodied in an axially vertical cylindrical jar 10 (typically of a size that can be held in a user's hand) having a main body 11, a lid 12 and a bottom cap 14 each comprising (for example) one or more molded plastic elements. The main body includes a downwardly tapering frusto-conical well 16 defining a central upwardly open well volume 18 with a lower end 20, and a cylindrical container side wall 22 concentrically surrounding the well 16 so as to define therewith a powder chamber 24 extending circumferentially around the well and having a lower end 30; an upper end 31 of the powder chamber is closed by a portion of the main body connecting the well and the side wall. Before the jar is used the powder chamber is filled with a quantity 32 of the loose powder (e.g. a cosmetic powder) which is to be held in and dispensed from the jar, and the central well volume (which extends vertically through the jar from the top to the bottom of the jar) is empty.

The lid 12 is mounted by mating threads 33*a*, 33*b* on the top of the main body 11 so as to be removable therefrom, enabling a user to access the upwardly open well volume with an applicator such as a bristle-headed brush B (shown in broken lines in FIG. 4) for picking up powder from the bottom of the well and transporting and applying the powder to a selected area of the user's skin. The bottom cap is mounted by mating threads 34*a*, 34*b* on the lower end of the main body 11 so as to be vertically movable relative thereto, by relative screwing and unscrewing motion, between an upper first position (FIGS. 3 and 7) and a lower second position (FIGS. 4 and 8), but as explained below, the threaded engagement of the bottom cap and main body is such that once the bottom cap has been initially screwed on the main body past the second position toward the first position, it cannot be removed from the main body, i.e. it cannot move back in the other direction beyond the second position.

Fixedly secured within the bottom cap is a generally dish-shaped bottom member 35 disposed below and facing the circular lower end edge 37 of the well 16 and extending to the inner surface of the container side wall 22 (or to an annular seal 38 mounted on that surface, see FIGS. 7 and 8) so as to close the lower ends of the well volume 18 and the powder chamber 24 by engaging the well lower edge 37 when the bottom cap is in the aforesaid first position (FIG. 3), thereby preventing passage of powder from the powder chamber to the well volume. When the bottom cap is rotated relative to the main body so as to descend from the first position to the second position (FIG. 4), the bottom member moves downwardly away from the lower edge 37 of the well, opening a small continuous gap 40 between the bottom member and the well edge 37 around the periphery of the well. The lower end of the powder chamber 24 now communicates through this gap with the well volume, permitting limited passage of powder from the powder chamber into the lower end 20 of the well volume. That is to say, the bottom member (mounted in the bottom cap) and the well (fixedly secured to the main body) are relatively rotatable between a first position in which the well and the bottom member cooperatively prevent passage of powder from the powder chamber to the well, and a second position in which at least one gap opens to permit limited passage of powder from the powder chamber into the lower end of the well volume where it can be picked up by an applicator.

The central portion 42 of the bottom member 35 effectively serves as a floor of the well volume 18 and may be substantially planar; powder passing from chamber 24 to well volume 18 when the gap 40 is open lies on this portion 42 of the bottom member and is accessible to an applicator such as the aforementioned bristle-headed brush B inserted manually into the well volume from the top. To facilitate such pick-up of powder, the horizontal diameter of the well volume lower end 20 is sufficiently large to accommodate substantial lateral movement of the brush around the surface of bottom member portion 42. The annular outer portion 44 of the bottom member 35 curves or slopes upwardly so that its periphery 46 engages the inner surface of the container side wall 22 (or annular seal 38) not only when the bottom member is in the closed first position of FIGS. 3 and 7 but also when it is in the open-gap second position of FIGS. 4 and 8. Consequently, powder cannot escape from the powder chamber, in either position of the bottom member, except through the gap 40.

Figures 5, 6A, 6B:
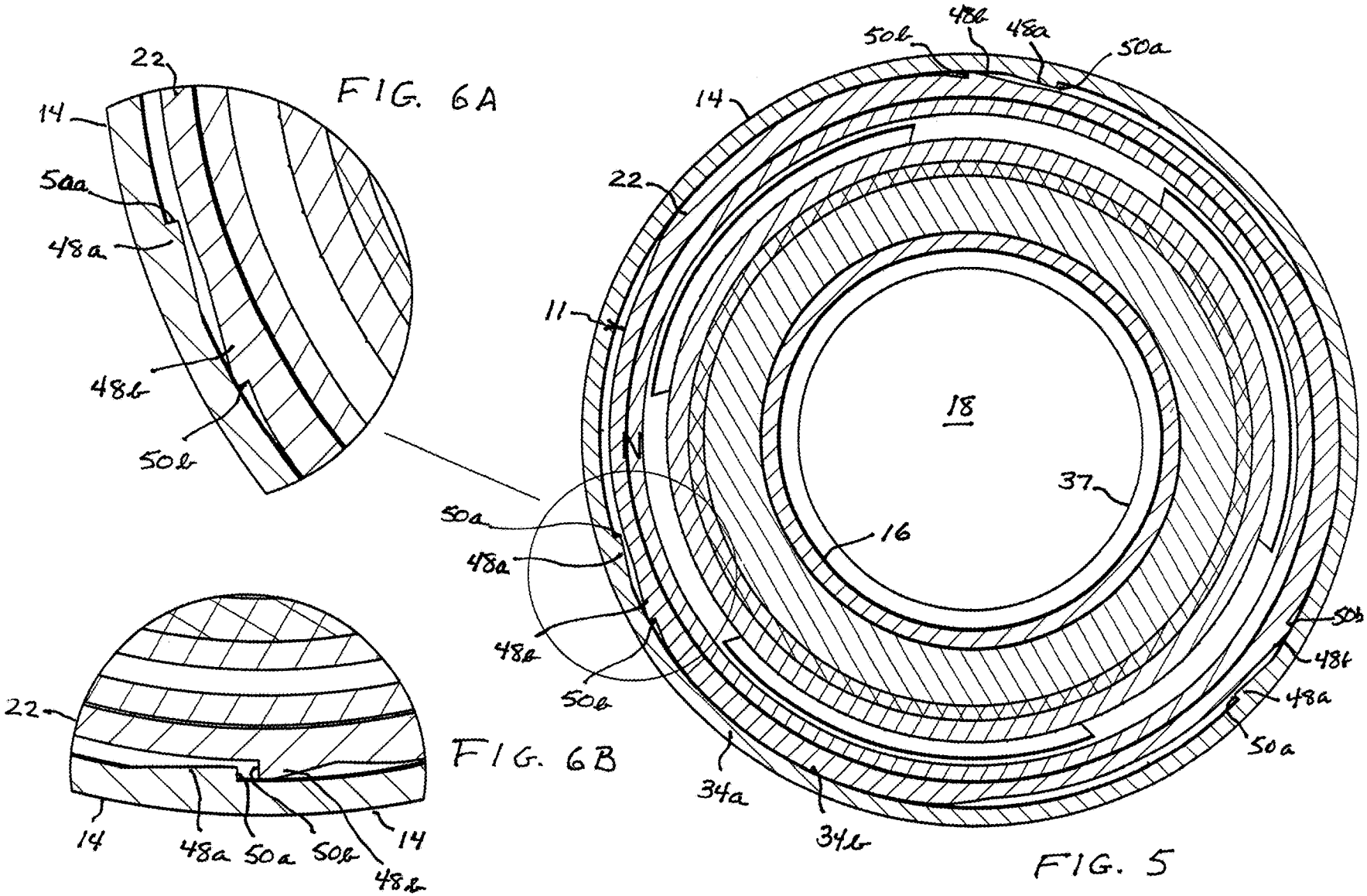
FIG. 5 is an enlarged sectional plan view of the container of FIG. 1 illustrating the threaded interengagement of the bottom cap and main body that permits limited relative axial movement thereof and prevents complete separation thereof after they are initially threaded together.
FIG. 6A is a further enlarged fragmentary sectional plan view of the container of FIG. 1 (the portion indicated by circle N in FIG. 5) illustrating the positions of the threads of the bottom cap and main body just before they are interlocked to prevent complete separation.
FIG. 6B is a view similar to FIG. 6A illustrating the positions of the threads of the bottom cap and main body just after they are interlocked to prevent complete separation.
Figure 7:
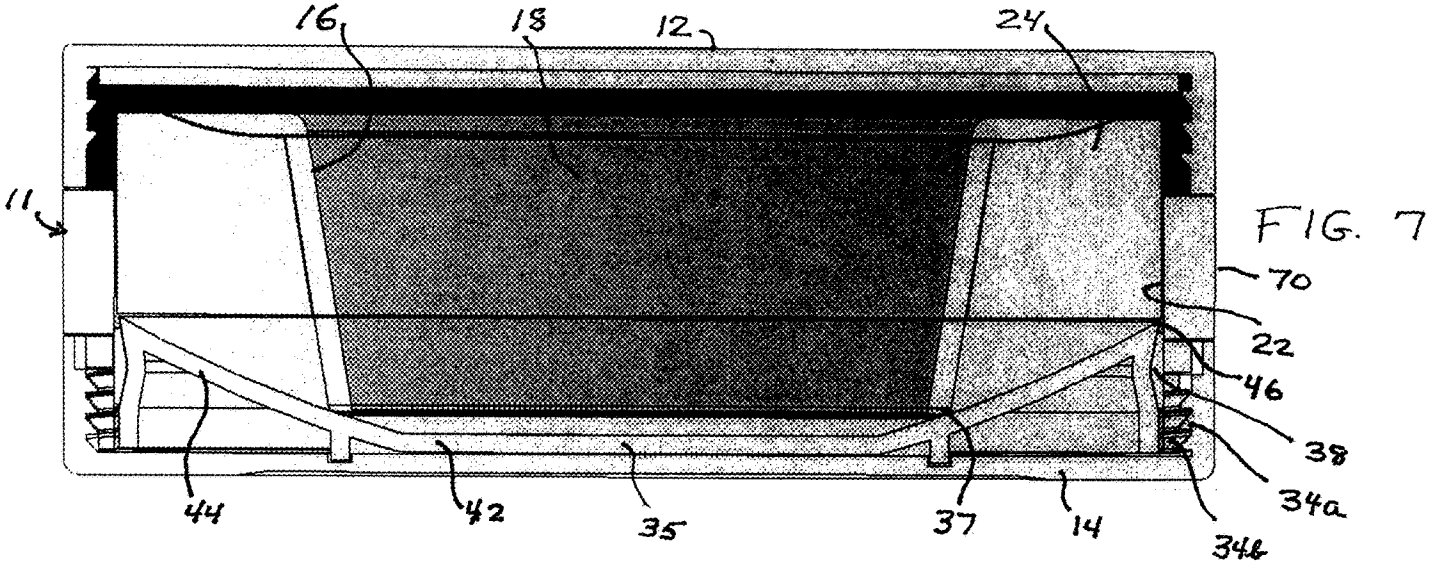
FIG. 7 is an enlarged sectional elevational view of the FIG. 1 container with the bottom cap and main body in the fully closed position of FIG. 3.
Figure 8:
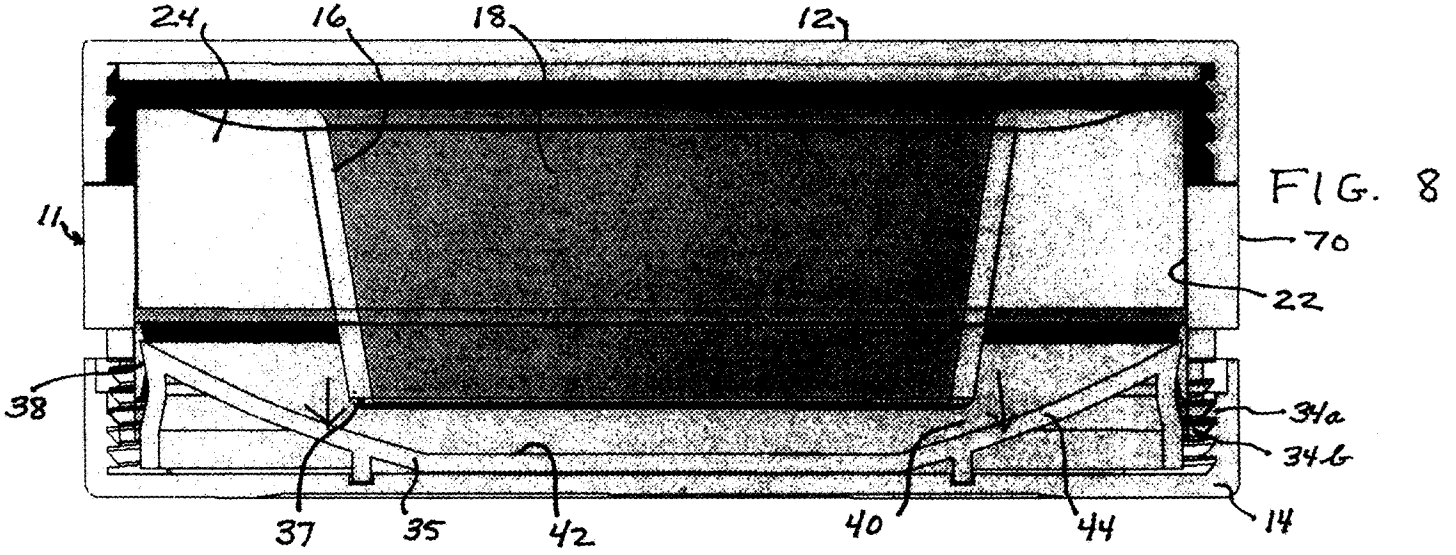
FIG. 8 is a similarly enlarged sectional elevational view of the FIG. 1 container with the bottom cap and main body in the powder-dispensing position of FIG. 4.
Figure 10:
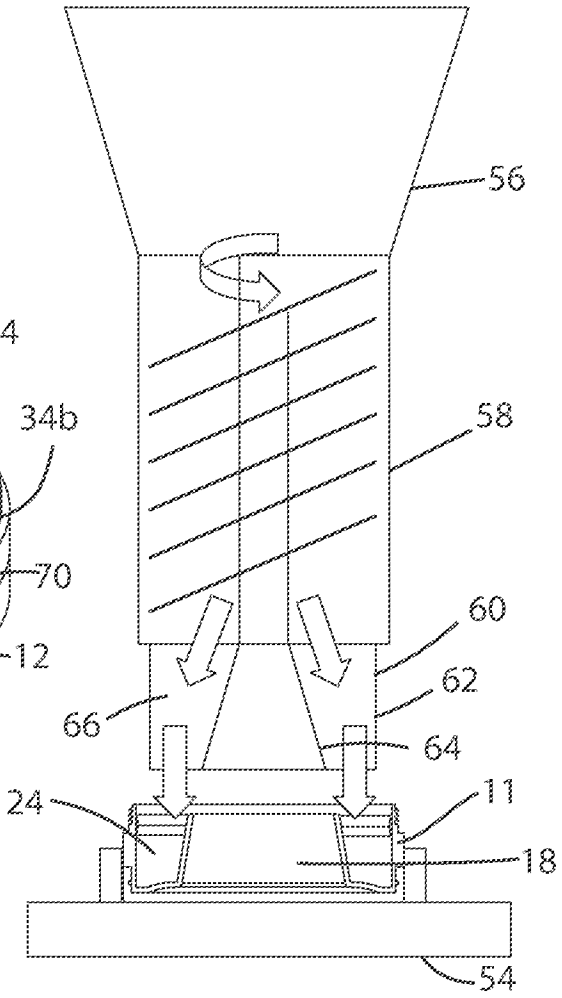
FIG. 10 is a partly schematic sectional elevational view of the container of FIG. 1 in the inverted position of FIG. 9 being filled with loose powder from a powder hopper.

The features preventing removal of the bottom cap 14 from the main body 11 after the cap is initially screwed on the main body are illustrated in FIGS. 5, 6A and 6B. The mating threads 34*a* (on the bottom cap) and 34*b* (on the container side wall 22) have three sets of ramps or bumps 48*a* (on threads 34*a*) and 48*b* (on threads 34*b*) respectively having flats 50*a* and 50*b* that interfere to prevent over-ride of the threads if a user attempts to unscrew the bottom cap beyond the second position after the bottom cap has initially been screwed onto the main body following the filling of the container with powder for dispensing. In particular, each ramp 48*a* and 48*b* is a non-return bump with a right-angle geometry (a flat 50*a* or 50*b* perpendicular to the tangent to the direction of screwing/unscrewing thread movement at the location of the flat); the flat 50*a* of each ramp 48*a* on the bottom-cap thread 34*a* faces away from the screwing direction of advance of the thread, while the flat 50*b* of each ramp 48*b* on the cylinder side wall 22 faces toward the latter direction. Thus, during initial mounting of the bottom cap on the side wall 22, the screw threads act normally; i.e., the ramps 48*a* and 48*b*, having relatively easy slopes and sliding easily over each other (deforming the plastic slightly), permit the bottom cap to be screwed on the side wall 22 all the way to the aforesaid first position. In the opposite (unscrewing) rotational direction, however, the flats 50*a* and 50*b* face each other and are positioned to engage interferingly with each other to prevent further unscrewing movement of the bottom cap when the bottom cap reaches the aforesaid second position relative to the container side wall 22.

Figure 9:
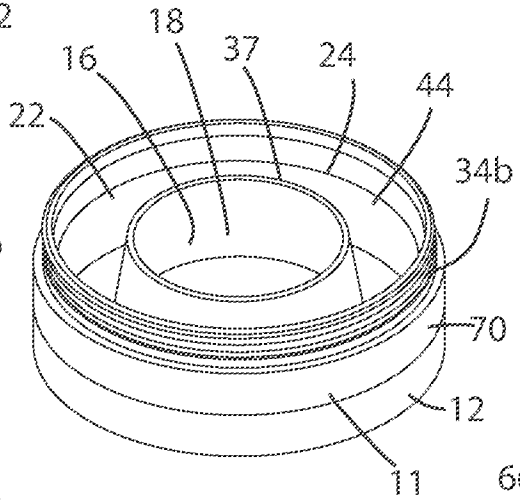
FIG. 9 is a perspective view of the container of FIG. 1 in inverted position for filling the powder chamber with loose powder, with the lid closed and the bottom cap not yet mounted.

The method of initial filling of the powder chamber 24 of the jar 10 with loose powder to be dispensed is shown in FIGS. 9-13. FIG. 9 is a perspective view of the main body 11 of the container, before mounting of the bottom cap but with the lid 12 screwed on, as positioned to receive the powder. The body 11 is inverted, resting on the lid 12 so that the lower end 30 of the circumferential powder chamber 24 defined by cylindrical container side wall 22 opens upwardly to receive the powder; the lower end 20 of the well volume 18 also opens upwardly, surrounded by the lower end edge 37 of the well 16.

The inverted main body, lid down, is placed on a vibrating table 54 (FIG. 10) beneath a filling arrangement including a powder hopper 56, a standard loose powder auger 58 extending below the hopper for effecting controlled downward advance of loose powder from the hopper, and a filling adapter 60 at the lower end of the auger. This filling adapter has a cylindrical outer side wall 62 and a downwardly flaring frustoconical central diverter 64 cooperatively defining an annular region 66, open at both top and bottom, for guiding all powder descending from the auger into the upwardly opening annular lower end of the powder chamber 24, i.e., preventing the powder from entering the well volume 18 or falling outside the container side wall 22.

After the hopper 56 has been supplied with loose powder to fill the jar 10, the auger 58 is driven (rotated) to advance the powder downwardly from the hopper into the filling adapter 60, which delivers the falling powder into the upwardly opening lower end of the powder chamber 24 while keeping the well volume 18 free of powder. When the powder chamber has been filled to a desired level the auger and vibrating table are switched off (the vibrating table serves to promote even distribution of the delivered powder within the powder chamber).

Figure 11:
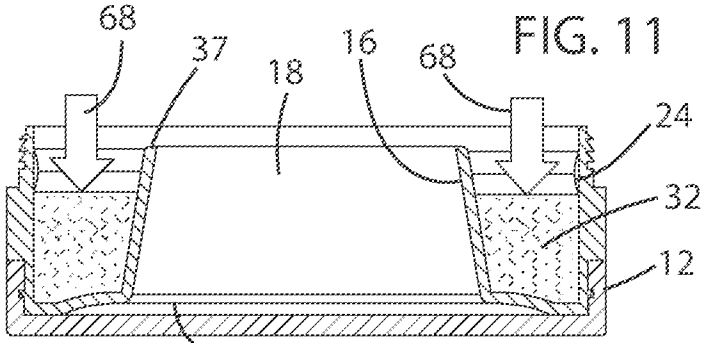
FIGS. 11, 12 and 13 are simplified sectional elevational views of the same container illustrating stages in the filling and post-filling assembly of the container.
Figure 12:
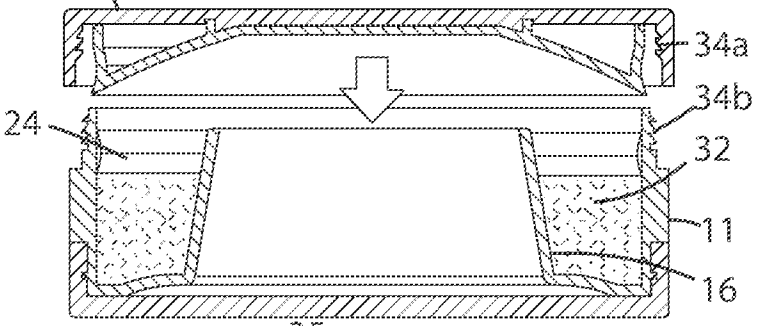
Figure 13:
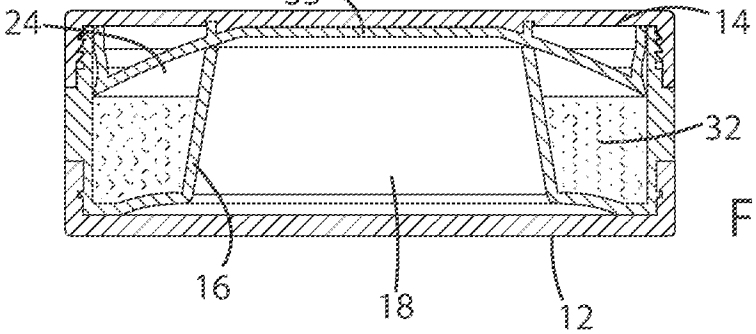
Figure 16:
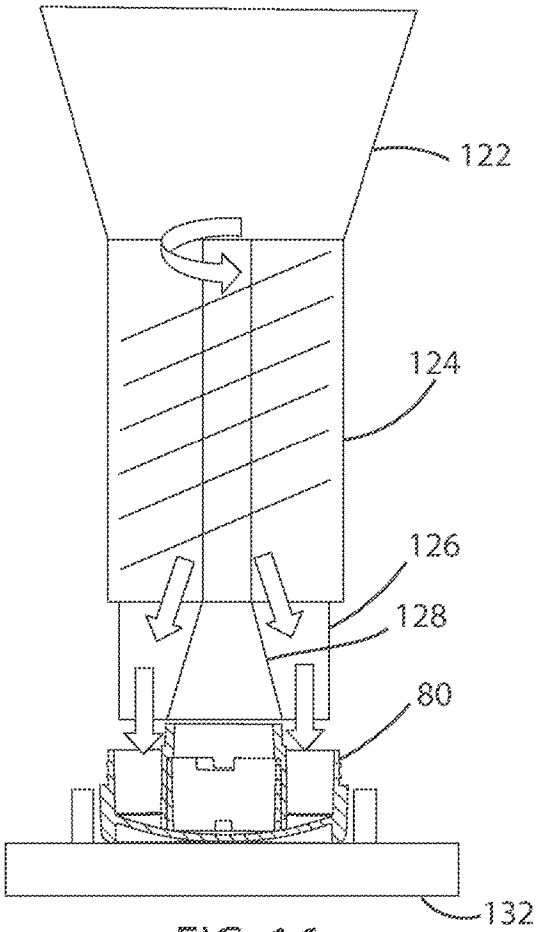
FIG. 16 is a similar view of the container of FIG. 14 being filled with loose powder from a powder hopper.
Figure 14:
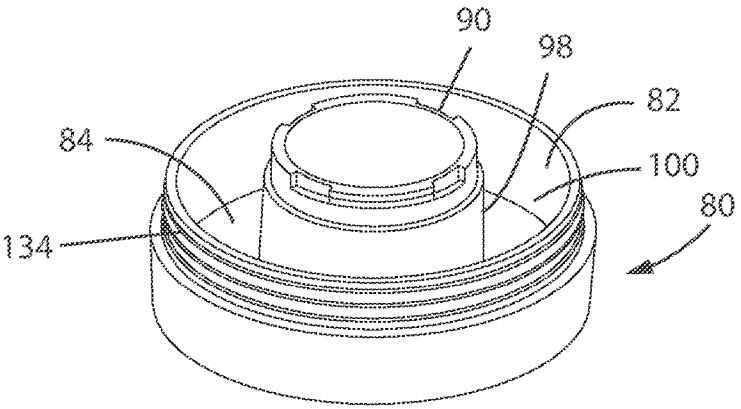
FIG. 14 is a perspective view of another embodiment of the container of the disclosure with the lid and filling cap not mounted.
Figure 15:
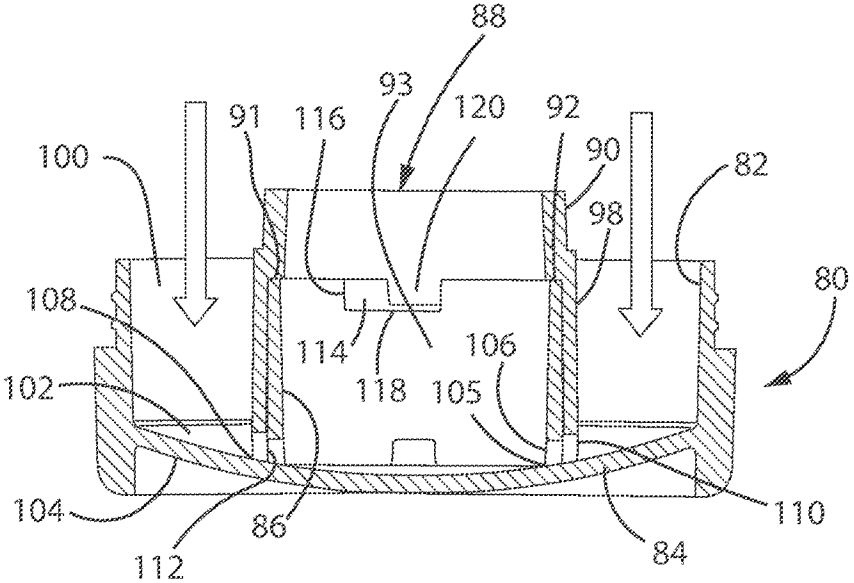
FIG. 15 is a schematic sectional elevational view of the container of FIG. 14 with the lid and filling cap not mounted.
Figure 24:
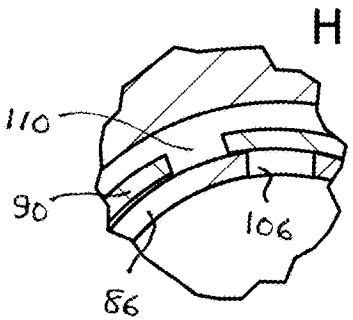
FIG. 24 is an enlarged (2:1) fragmentary view of the portion of FIG. 23 indicated by circle H in FIG. 23.
Figure 23:
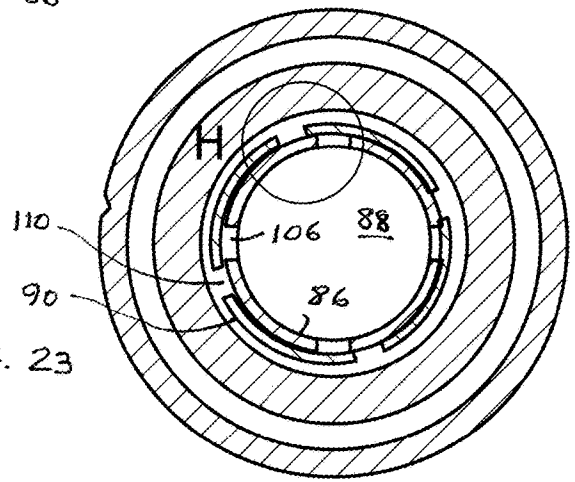
FIG. 23 is a view similar to FIG. 21 showing the wall openings or vents of the well in closed position.
Figure 26:
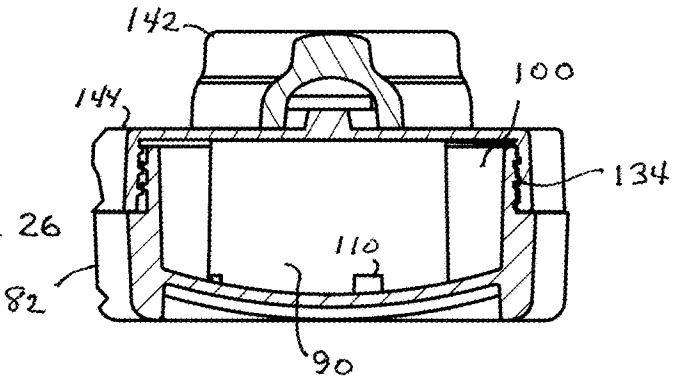
FIGS. 25 and 26 are sectional elevational views of the container of FIG. 14 respectively showing the openings or vents in open and closed positions.
Figure 22:
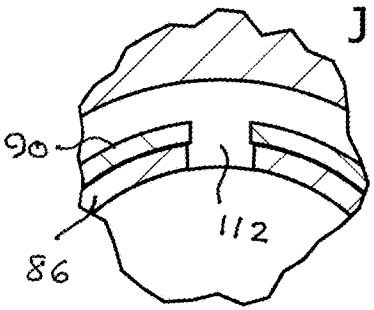
FIG. 22 is an enlarged (2:1) fragmentary view of the portion of FIG. 21 indicated by circle J in FIG. 21.
Figure 21:
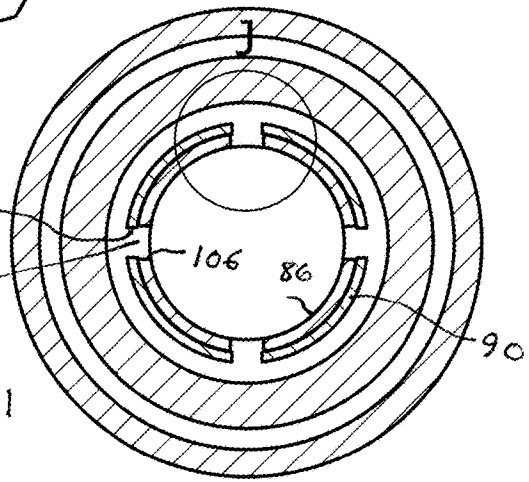
FIG. 21 is a sectional plan view of the container of FIG. 14 showing the wall openings or vents of the well in open position.
Figure 25:
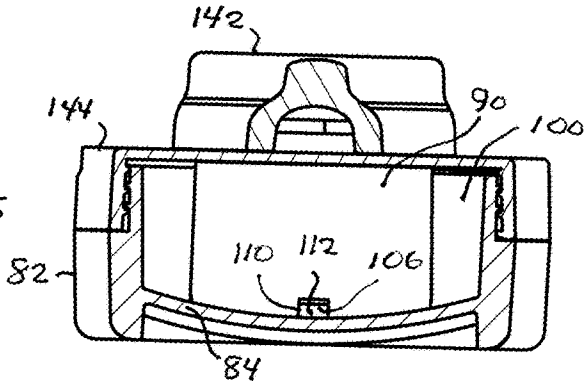

The filling of the powder chamber is also illustrated in FIG. 11, which represents the powder being delivered to the chamber by arrows 68. Once filed with the desired quantity of powder 32, the lower end of the powder chamber is closed (as is the lower end of the well volume 18) by mounting the bottom cap 14 on the lower end of the main body (FIG. 12). The cap screws smoothly onto the main body until it reaches the fully screwed position, i.e., the aforementioned first position (FIG. 13) because the ramps 46*a* and 48*b* on the mating screw threads permit such one-directional screwing movement, but thereafter the bottom cap is permanently held on the main body because the interengaging flats 50*a* and 50*b* prevent it from being unscrewed beyond the second position. The bottom member 35 engages the lower end edge of the well 16, isolating the well volume from the filled powder chamber so that when the jar 10 is turned into the upright position, with the bottom cap down and the lid 12 uppermost (FIG. 2), the well volume is entirely empty of powder.

Figure 3:
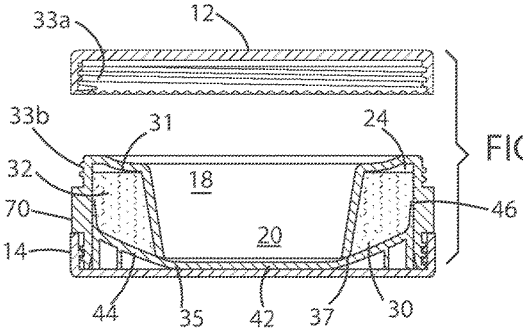

Use of the jar 10 for dispensing the contained loose powder without generating powder clouds may now be readily explained. Starting with the jar in the position shown in FIG. 2, a user opens the lid 12 by unscrewing and removing it, so that the empty well volume 18 is upwardly open for external access, but is isolated from the powder chamber at its lower end 20 (FIG. 3). Then, holding the exposed outer side surface 70 of the main body 11 with one hand, the user twists the bottom cap 14 with the other hand, to unscrew the bottom cap until it descends to the aforementioned second position (FIG. 4), at which it is stopped from further unscrewing by the above-described engagement of flats 50*a* and 50*b*. This restricted unscrewing motion opens the gap 40 between the well lower edge 37 and the bottom member 35, enabling a small amount or dose of powder to pass from the powder chamber 24 to the central flat portion 42 of the bottom member, which serves as the floor of the well volume. Such passage of powder is facilitated by the downward slope of the annular outer portion of the bottom member, which constitutes the floor of the powder chamber.

The user now introduces an applicator, such as the brush B having a rigid wood or plastic handle and a brush head of soft bristles at its end, into the well volume 18, and by manipulating the brush handle, swirls the bristles around the floor of the well volume to pick up the powder, which can then be carried on the brush out of the jar to a desired locality of application on the user's skin. The amount of powder delivered into the well from the powder chamber upon opening of the gap may be increased by shaking the jar or tapping the well 16 with the brush. When a desired application of powder is completed, the user twists the bottom cap 14 in a screwing-on direction while holding the main body at side surface 70, thereby closing the gap 40 by return of the bottom member to its first position.

The container 10 effectively eliminates or prevents generation of a powder cloud incident to dispensing the loose powder by limiting the amount of powder that is exposed and available for pickup by the applicator, the powder being dosed only a small amount at a time into the central well volume which is the only locality of exposure of any loose powder. The depth of the well further reduces any powder cloud generation.

FIGS. 14-28 show another embodiment of the container of the disclosure, viz., a jar 80 including a cylindrical container side wall 82, a bottom member 84, and a first upstanding cylindrical wall 86 of a well 88 all fixedly secured together (e.g. molded integrally). A second cylindrical wall 90 of the well 88 snugly concentrically surrounds, and is rotatable relative to, the first upstanding cylindrical wall 86 about a common vertical axis. Well wall 90 extends above well wall 86 and also above container side wall 82; at the top of wall 86, the inner cylindrical surface of wall 90 is offset inwardly to form an annular seat 91 resting on the top edge 92 of wall 86. Both cylindrical well walls 86 and 90 extend down to the bottom member 84, the first or inner well wall 86 being fixedly attached to the bottom member and the second or outer well wall 90 being rotatable relative thereto.

The inner surfaces of the two cylindrical well walls 86 and 90 respectively define upper and lower portions of a central axially vertical well volume 93 opening upwardly and closed at its lower end 94 by a central portion 96 of the bottom member 84 which is fixedly secured to the bottom member. The outer surface 98 of well wall 90 and the inner surface of the container side wall 82 cooperatively define an upwardly open powder chamber 100 (for holding loose powder to be dispensed) closed at its lower end 102 by an annular peripheral portion 104 of the bottom member 84 fixedly secured to the lower end of the container side wall.

Along its lower edge 105, where it joins the bottom member, the inner well wall 86 is formed with four relatively small openings or vents 106, shown as rectangular, spaced equidistantly around the periphery of wall edge 105. These openings are equal in size and shape; each has a horizontal length which is a minor fraction of the distance between adjacent openings 104 and a height less than its length. The lower edge 108 of the outer well wall 90 is similarly formed with four equidistantly spaced openings or vents 110, at least substantially the same in size as the inner well wall openings 106. The outer well wall 90 is capable of limited rotation about the aforesaid vertical axis, relative to the inner well wall 86, between a first angular position in which the outer wall openings 110 are completely out of register with the inner wall openings 106 (i.e., each opening 106 is fully occluded by a portion of the outer wall 90 where no opening exists), such that no gap exists between the powder chamber and the well volume, and a second angular position in which the outer wall openings 110 are substantially entirely in register with the inner wall openings 106, such that each pair of openings 106, 110 cooperatively constitutes a gap or gap portion 112 through which a small amount or dose of loose powder contained in chamber 100 can pass into the lower end of central well volume 93 to rest on the bottom member portion 96 within the well volume for pickup by an applicator.

The top edge 92 of inner well wall 86 is formed with four equidistantly spaced upwardly open notches 114 each having vertical ends 116 and a horizontal lower margin 118 substantially twice as long as the length of each aperture 106. Four equidistantly spaced teeth 120 formed on and projecting inwardly from the inner surface of the outer well wall 90 immediately below seat 91 are respectively received in the notches 114, each of teeth 120 having a horizontal length that is substantially half that of each notch 114. The locations of the notches, and the teeth, on the respective well walls relative to the wall openings 106 and 110 are such that rotation of outer wall 90 relative to inner wall 86 is limited (by interfering engagement between vertical end edges of notches and teeth) to a range between the aforesaid first and second angular positions respectively corresponding to closure and opening of gaps between the powder chamber and the central well volume. At its upper end, the outer well wall 90 has four equidistantly spaced indentations 121 for respectively receiving four vertical ribs 140 of a lid 142 that impart rotary movement (through the range just defined) to wall 90 when the lid is turned, enabling a user to open and close the aforementioned gaps 112 for permitting or preventing passage of loose powder from the bottom of the powder chamber to the bottom of the well volume.

Filling of the powder chamber 100 (FIG. 16) with loose powder to be dispensed from the jar 80 is performed in the same manner as in the case of the jar 10 of FIGS. 1-13, using apparatus including a powder hopper 122, standard loose powder auger 124, filling adapter 126 with central diverter 128, and vibrating table 132, except that instead of being inverted, the jar 80 is positioned upright on the vibrating table and the powder is delivered into the open upper end of the powder chamber 100 while being prevented by the diverter from entering the open upper end of the well volume 93.

When filling is complete, a filling cap 144 is non-removably mounted by thread 134 on the upper end of the container side wall 82 to permanently close the powder chamber 93 defined between the container side wall 82 and well 88, and to trap the rotatable well wall 90 within the jar. The aforementioned lid 142 is rotatably removably mounted on the container (viz., on the filling cap 144) for closing and opening an upper end of the well, the lid and an upper end portion of the outer well wall 90 having, as mentioned above, mutually engageable ribs 140 and indentations 121 such that rotation of the lid on the container in opposite directions rotates the wall 90 to open and close the gaps 112. An applicator 146 with a bristle brush head may be mounted in the lid.

Figure 28:
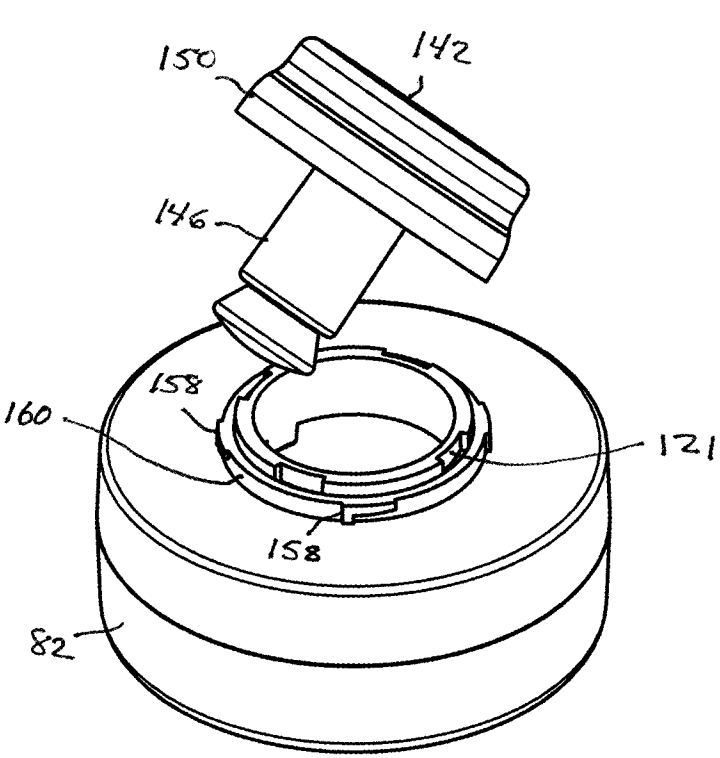
FIGS. 27 and 28 are exploded perspective views of the container of FIG. 14 with the lid separated from the filling cap and jar body.
Figure 27:
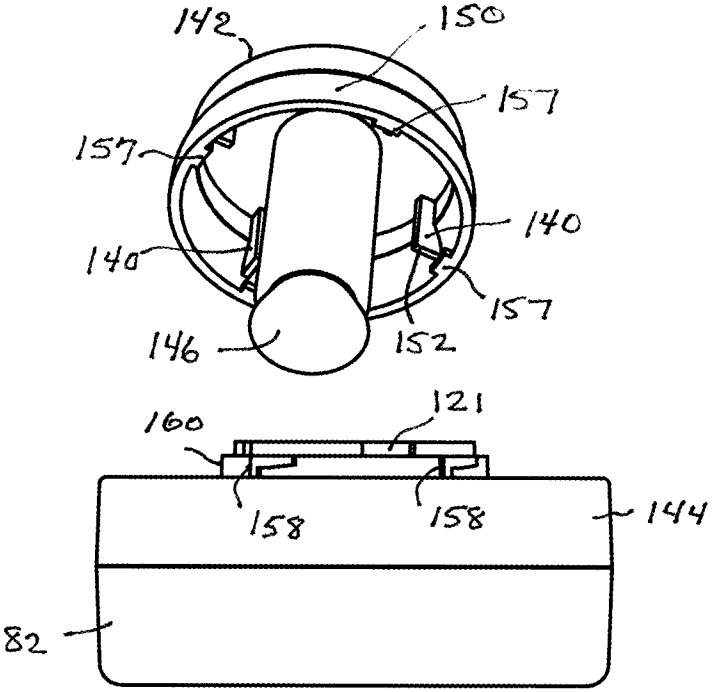

Specifically, a skirt 150 of the lid 142 surrounds applicator 146 and bears, on its inner surface, the four vertical ribs 140 respectively received in the indentations 121 of the outer well wall when the lid is mounted on the filling cap 144. The lower edges 152 of ribs 140 are spaced above the lower edge 154 of skirt 150, which bears four short and equidistantly spaced horizontal ribs 157 projecting inwardly. These ribs 157 are respectively inserted in four horizontal open-ended sockets 158 formed on the outer side surface of a short central cylindrical neck 160 of the filling cap; the upper end of rotatable well wall 90, including the indentations 121, projects through and above the filling cap neck 160, as best seen in FIGS. 27-28. In the fully assembled container of FIGS. 14-28, lid 142 is mounted on the filling cap by insertion of the horizontal ribs 157 into the sockets 158, i.e. by turning the lid relative to the filling cap, the vertical ribs 140 being received in the indentations 121 at the top of rotary well wall 90.

To remove the lid from the container for dispensing powder, the lid is initially turned in a direction for withdrawing the horizontal ribs from the sockets; the vertical ribs 140 and indentations 121 are so positioned and arranged that this initial turning of the lid does not rotate the wall 90. After the ribs 57 are freed from the sockets 158, continued turning of the lid in the same direction causes the vertical ribs 140 to engage vertical edges of the indentations 121 so as to rotate the wall 90 around the inner well wall 86 from the closed position (in which openings 106 and 110 are out of register) to the open position (in which the openings 106 and 110 are in register) providing the gaps 112 through which a small amount of loose powder is dispensed from the powder chamber into the bottom of the well for pick-up by the applicator. When the jar 80 is thus employed to dispense the contained loose powder, it affords advantages similar to those provided by the jar 10 of FIGS. 1-13 with respect to the prevention or minimization of powder cloud generation.

Figure 29A:
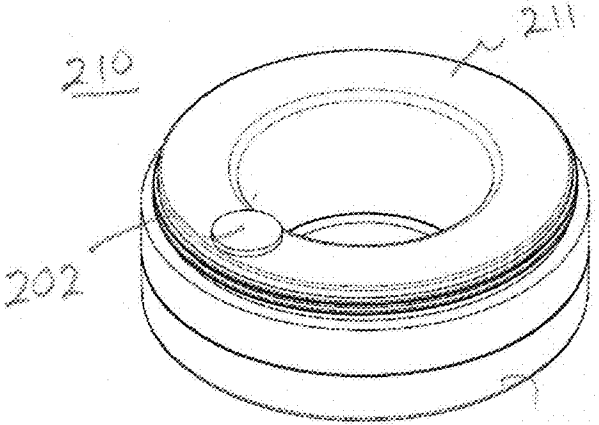
Figure 29B:
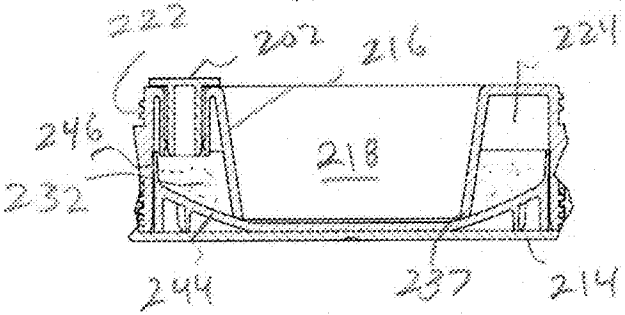

FIGS. 29A, 29B, 30A, 30B, 31A, and 31B illustrate a further embodiment of the disclosure. FIG. 29A shows a perspective view of a container 210 similar to the one illustrated in FIGS. 1-8. The container includes a main body 211 and bottom cap 214. As shown in the cross section in FIG. 29B, bottom cap 214 threads onto main body 211. Side wall 222 of main body 211 forms an outer wall of powder chamber 224. Frustoconical wall 216 of the main body 211 forms an inner wall of the powder chamber 224 and the outer wall of well 218. Wall 216 has a lower edge 237. When the container is in a first, closed position engagement of the lower edge 237 with the upper surface 244 of bottom cap 214 closes chamber 224 and prevents powder in chamber 224 from flowing into well 218. As with previous embodiments, rotation of the main body 211 with respect to the bottom cap 214 causes the cap to move to a second, open position away from the main body, separating edge 237 and surface 244, allowing a quantity of powder in chamber 224 to flow into well 218.

Figure 30A:
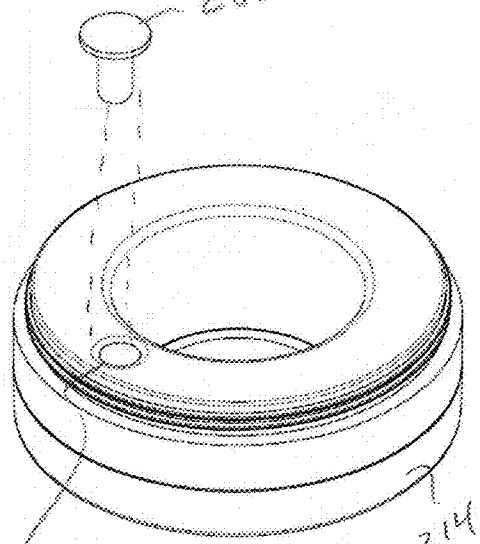
Figure 30B:
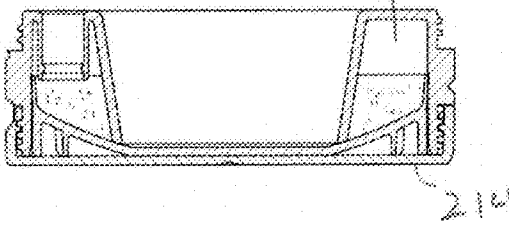

Main body 211 includes a fill hole 204 that connects with chamber 224. Plug 202 is sized to form an interference fit with hole 204. According to one embodiment, friction between plug 202 and the sides of hole 204 keep the plug in the hole until a user removes the plug, as shown in FIG. 30A. According to another embodiment, plug includes a groove about its circumference that engages with a protrusion on the inner surface of hole 204. The groove and protrusion are positioned to create a snap fit connection between the plug and the hole. According to another embodiment plug 202 includes threads that engage with threads on the inner surface of hole 204 to removably fix the plug in the hole.

Figure 31A:
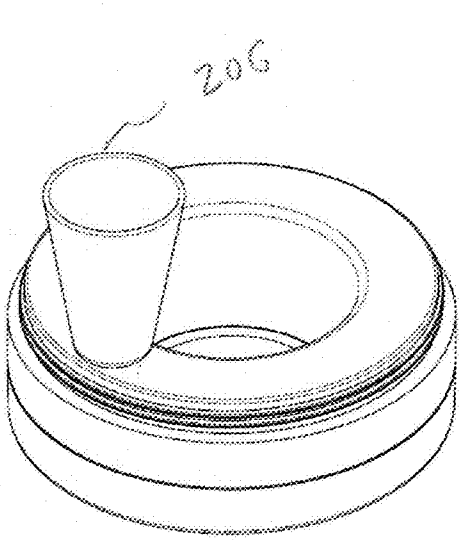
FIGS. 29A, 30A, and 31A are perspective views of another embodiment of the container of the disclosure showing a removeable cap for filling the container.
Figure 31B:
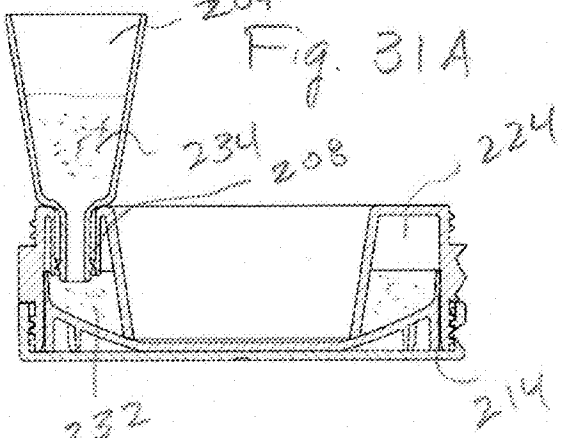
FIGS. 29B, 30B and 31B are sectional elevational views of the container of FIGS. 29A, 30A, and 31A.

As shown in FIG. 31A, a filling funnel 206 is provided. Funnel 206 has a bottom extension 208 that is shaped to fit within hole 204 and a hopper 209 positioned above the extension that is open to receive refill powder 234. As shown in FIG. 31B, refill powder 234 in hopper 209 flows through extension 208 and into chamber 224. This allows a user to replenish the supply of powder in chamber 224. Once the contents of chamber 224 are replenished, funnel 206 is removed from hole 204 and plug 202 is replaced, closing chamber 224.

Figure 32:
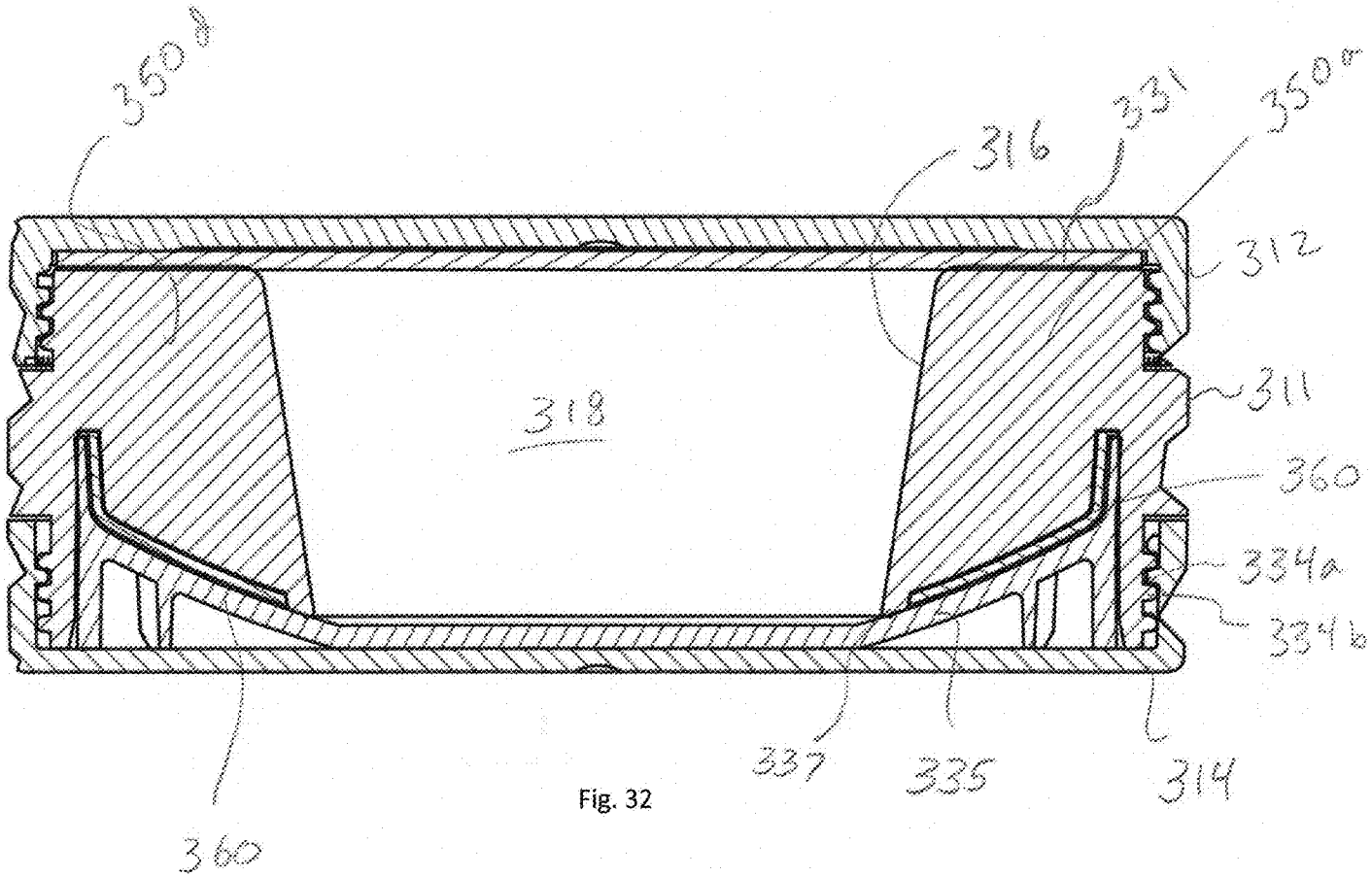
FIG. 32 is a sectional elevational view of yet another embodiment of the container of the disclosure showing baffles creating a plurality of chambers for storing and dispensing powder.
Figure 33:
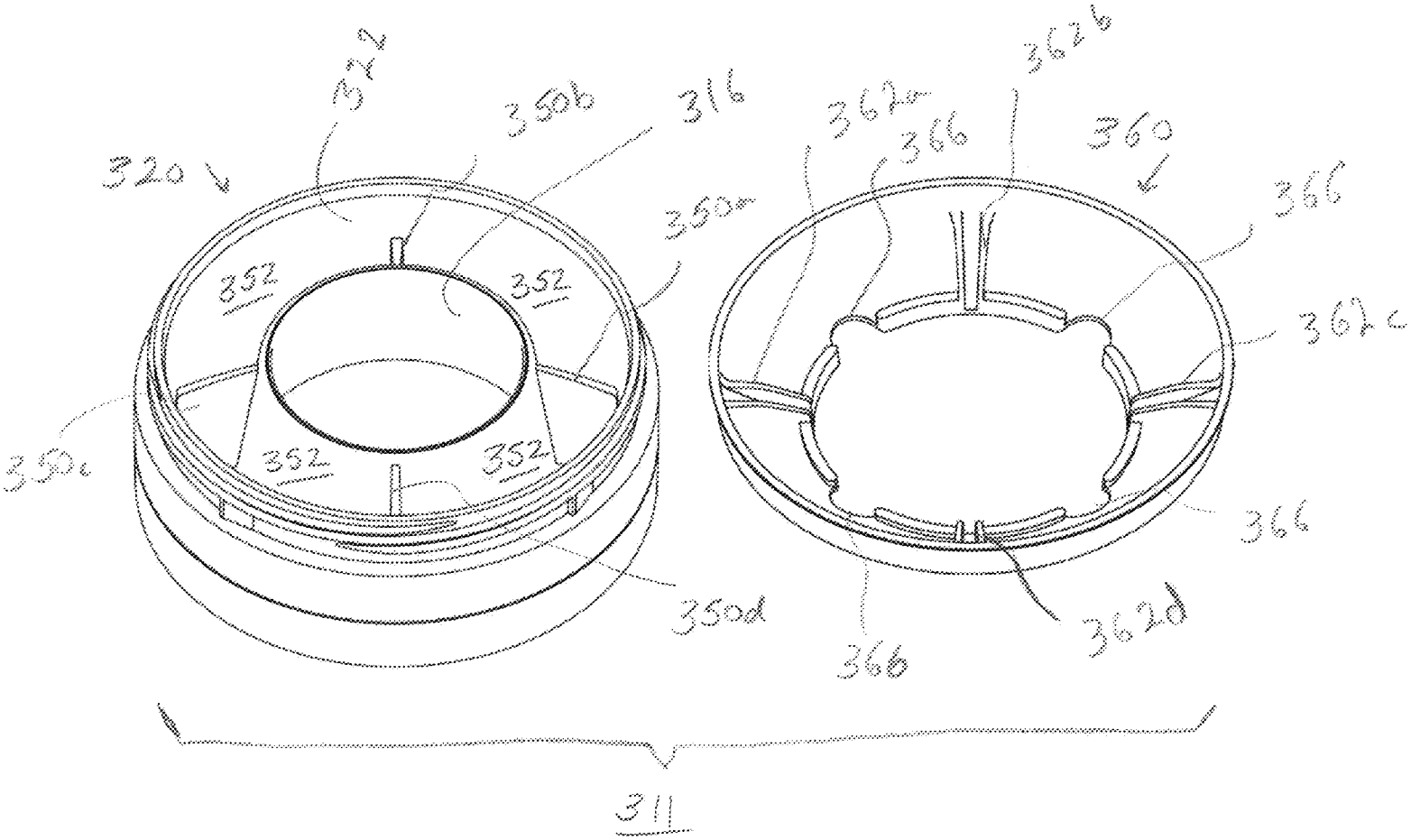
FIG. 33 is an exploded perspective view of the container of FIG. 32.
Figure 34:
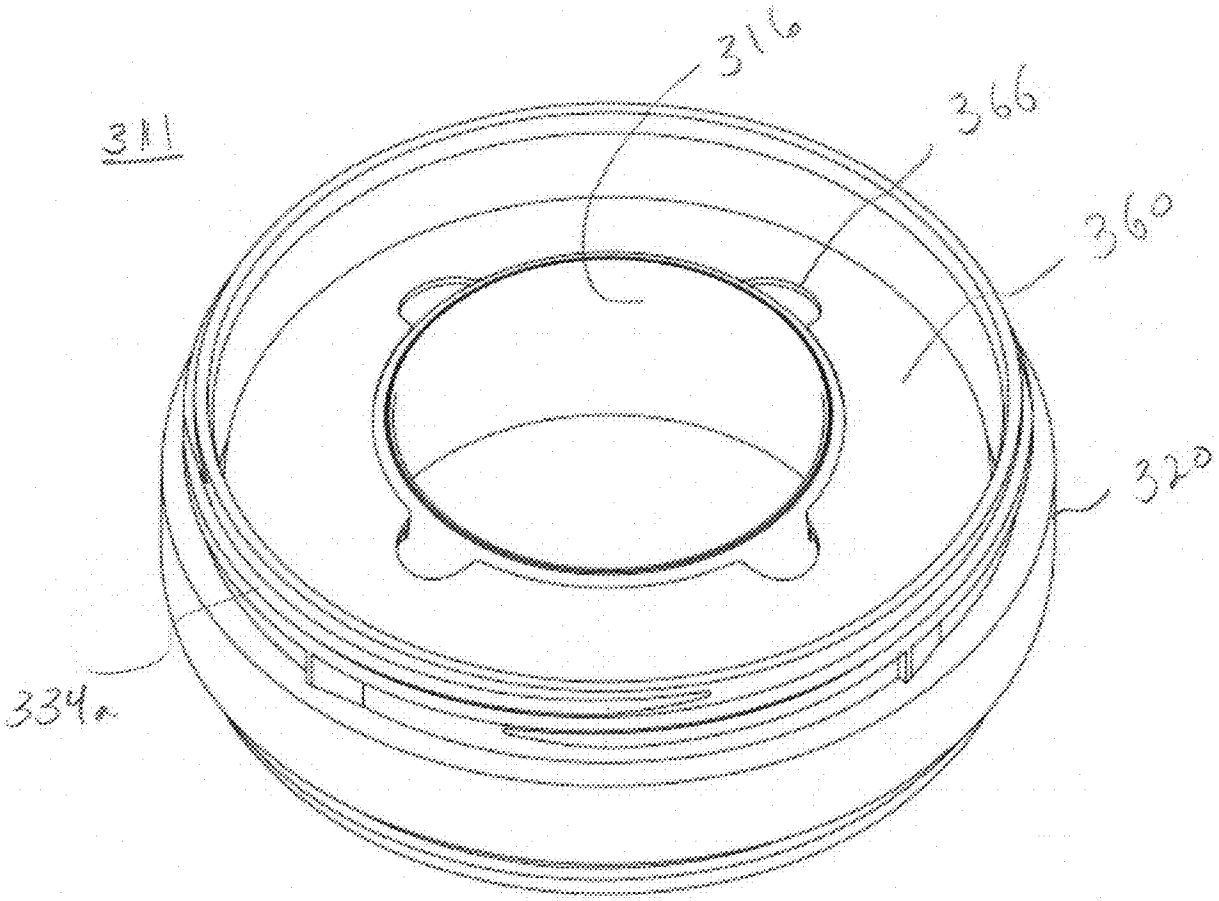
FIG. 34 is sectional elevational view of the container of FIG. 32 with the chamber cap not yet mounted.

FIGS. 32, 33, and 34 show a container according to another embodiment of the disclosure that includes multiple chambers for holding different powders separate from one another. FIG. 32 shows a cross section of a container according to this embodiment. FIG. 33 shows a perspective view of the body 311 of the container with chamber cap 360 removed from chamber member 320 to show a plurality of powder chambers 352. FIG. 34 shows body 311 with chamber cap 360 in place on chamber member 320.

As shown in FIG. 32, well 318 is provided in the center of the container. Threads 334*a* on body 311 engage with threads 334*b* on bottom cap 314 to connect the body with the cap. As with previously disclosed embodiments, a disk-shaped bottom member 335 on cap 314 engages with the lower edge 337 of inner wall 316 when the container is in a closed, first position, holding powder within powder chambers 352, as will be discussed below. Rotation of cap 314 with respect to body 311 unscrews threads 334*a* and 334*b* to move bottom member 335 away from edge 337 into the second position, allowing powder contained in powder chambers 352 to flow into well 318. Lid 312 is threaded onto main body 311 to close well 318 when the container is not in use. Foam seal 331 is adhered to the inner surface of lid 312 and presses against surfaces of body 311 to form a resilient, airtight closure.

FIG. 33 shows main body 311, which is composed of chamber member 320 and chamber cap 360. FIG. 34 shows chamber cap 360 positioned on chamber member 320. Body 311 in FIGS. 33 and 34 is upside down with threads 334*a* upward as compared with the assembled container in FIG. 32. Inner wall 316 of chamber member 320 forms the outer side of well 318 and the inner sides of the powder chambers 352 when the container is assembled. The outer side of side wall 322 forms the outer surface of body 311 and the outer sides of chambers 352.

As shown in FIG. 33, a plurality of baffles 350*a-d* extend from inner wall 316 to side wall 322. Note that only two of the baffles 350*a* and 350*d* are visible in the cross-sectional view of FIG. 32. Walls 316 and 322 and baffles 350*a-d* are connected with one another to form separate, upwardly closed chambers 352. In this illustrative embodiment, four baffles 352*a-d* are shown forming four chambers 352. The disclosure is not limited to four chambers and a greater or lesser number of chambers may be provided within the scope of the disclosure.

As shown in FIG. 33, chamber cap 360 is provided with a plurality of slots 362*a-d* positioned to engage with corresponding ones of baffles 350*a-d*. Notches 366 are provided along the inner circumference of chamber cap 360. According to one embodiment, each notch 366 is located mid-way between slots 362*a-d* and each forms an opening for a respective chamber 352.

FIG. 34 shows chamber cap 360 engaged with chamber member 320. Corresponding baffles 350*a-d* are engaged with slots 362*a-d*. According to one embodiment, chamber cap 360 is fixed to chamber member 320 by a method known in the field, for example, by welding or gluing or by providing interengaging structures to snap fit the parts together. According to a further embodiment, chamber cap 360 and chamber body 320 are removeably connected with one another. Notches 366 provide openings for each respective chamber to allow powder to be released, as will be described below.

As shown in FIG. 32, when main body 311 is in its closed, first position, edge 337 of inner wall 316 is positioned against bottom member 335. In addition, chamber cap 360 is positioned against bottom member 335. In this position, notches 366 are pressed against the bottom member, preventing powder from exiting the chambers 352. When bottom cap 314 is rotated relative to body 311, bottom member 335 moves away from chamber cap 360 into the open, second position so that notches 366 are in communication with well 318, allowing powder from each of the chambers 352 to flow into well 318.

Figure 4:
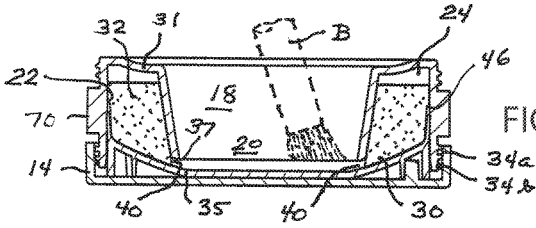
Figure 1:
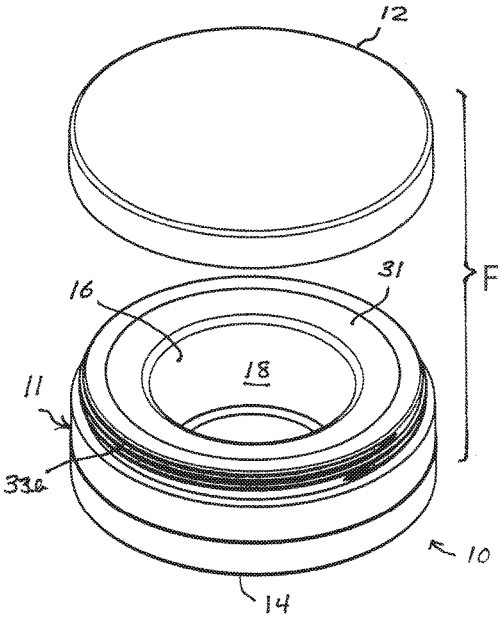
FIG. 1 is an exploded perspective view of a loose powder container embodying the present disclosure in a particular form, with the lid separated from the main body.

In this embodiment, four chambers 352 may each hold a different powder. Each powder flows into well 318 separately through the respective notch 366, allowing a user to blend the powders, for example, using a brush B, as shown in FIG. 4. By providing powders in separate, closed chambers, a container according to the present embodiment allows different powders, that may interact chemically with one another during storage, to remain separate until they are used.

Figure 35:
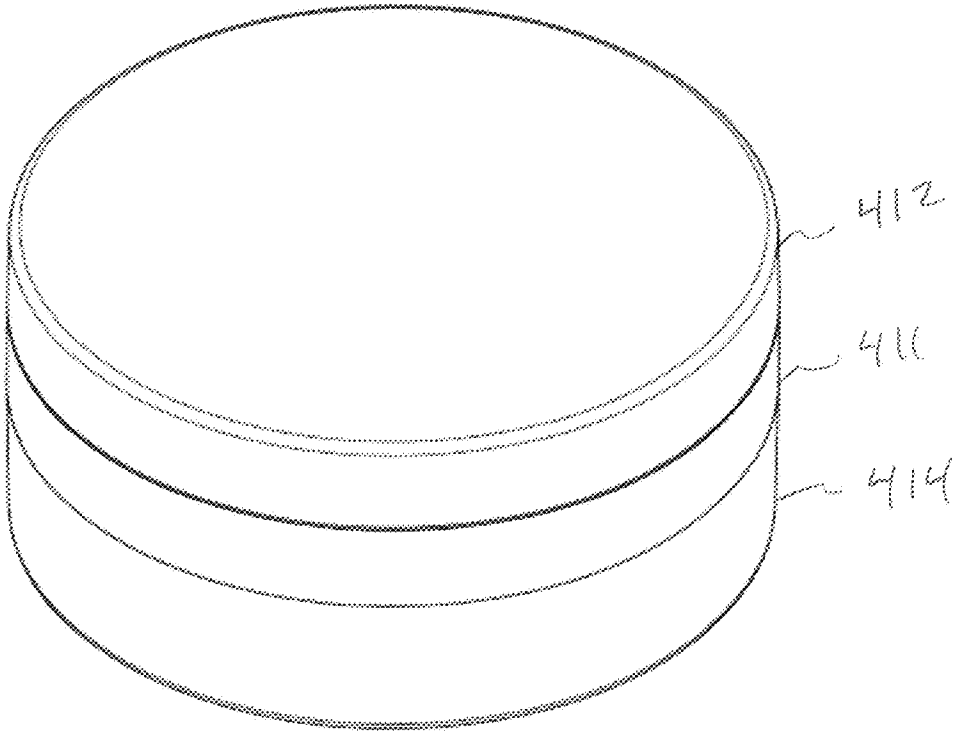
FIG. 35 is a perspective view of a further embodiment of the container of the disclosure for holding and dispensing material stored as frangible beads.
Figure 36:
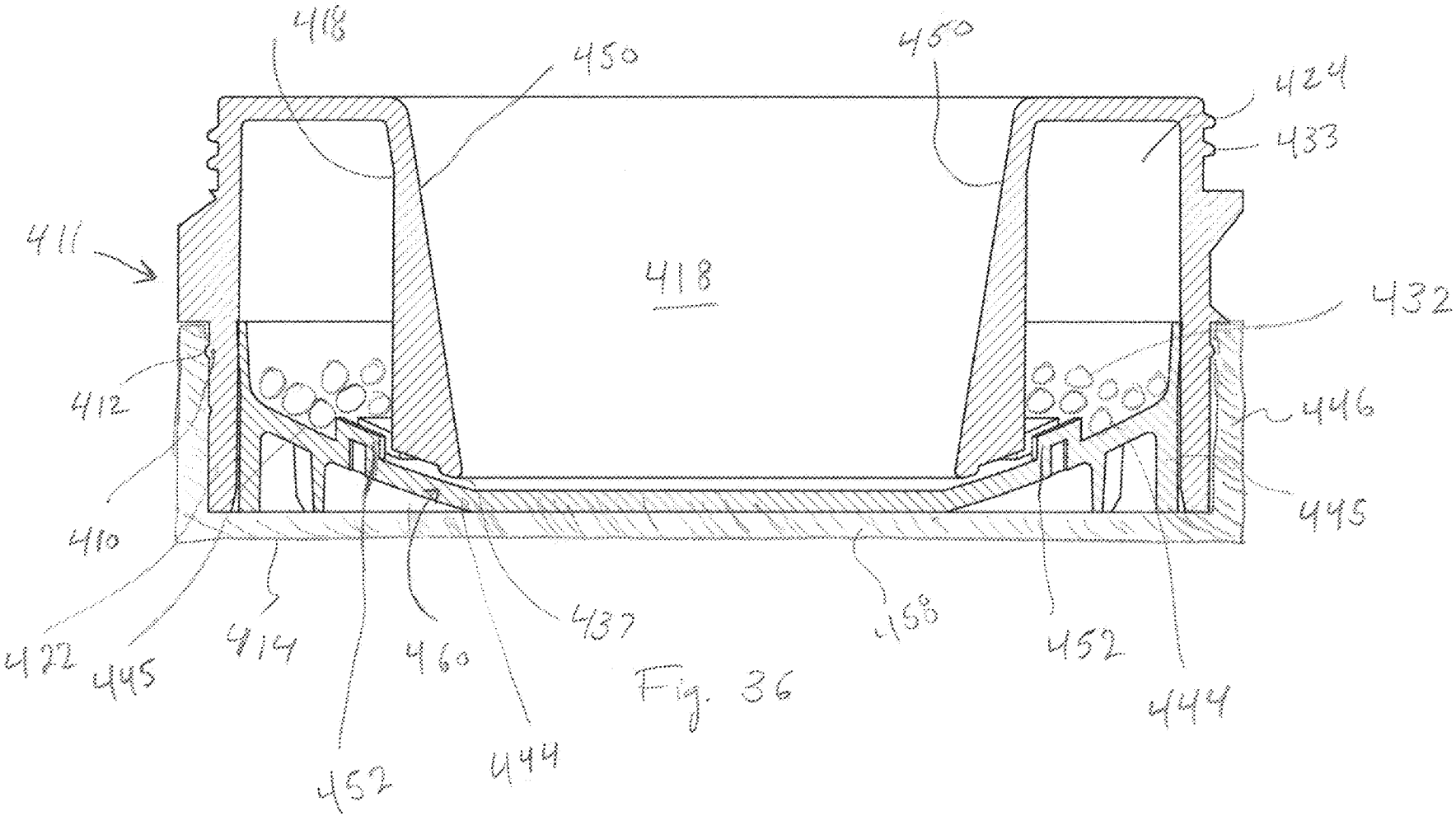
FIG. 36 is a sectional elevational view of the container of FIG. 35.

FIGS. 35 to 39 show another embodiment of a container for storing and delivering a product used in powdered form that is supplied as friable beads. As shown in FIG. 35, the container has a cap 412, a main body 411, and a base 414. Cap 412 is removably connected with main body 411 by interlocking threads on the inside surface of the cap and the outside surface of the main body. FIG. 36 shows a cross section of the main body 411 and base 414 with the cap removed. Threads 433 near the upper rim of the main body engage with the cap 412.

Figure 37:
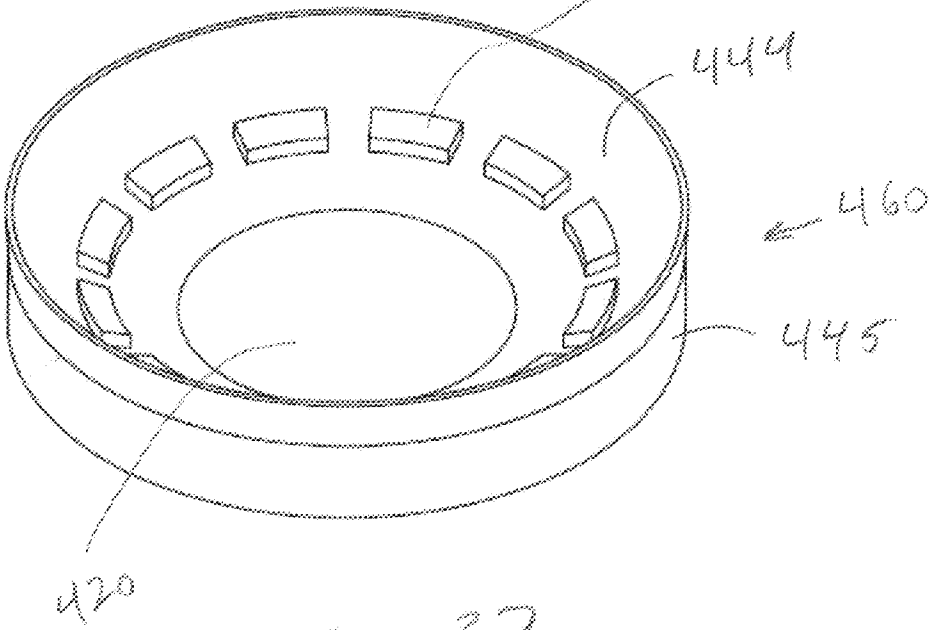
FIG. 37 is an elevational view of a pan portion of the container of FIG. 35.

Base 414 includes bottom component 458 and pan 460. FIG. 37 shows pan 460 separable from bottom component 458 according to one embodiment. According to another embodiment, bottom component 458 and pan 460 are formed as a unitary body, for example, by molding. Pan 460 includes an outer annular region 444 surrounding a central platform 420. One or more protrusions 452 are arranged circumferentially on the annular region 444.

As shown in FIG. 36, bottom component 458 has vertically extending outer wall 446. Pan 460 has a vertically extending outer wall 445. Walls 445 and 446 are concentrically arranged with a gap between them.

Figure 38:
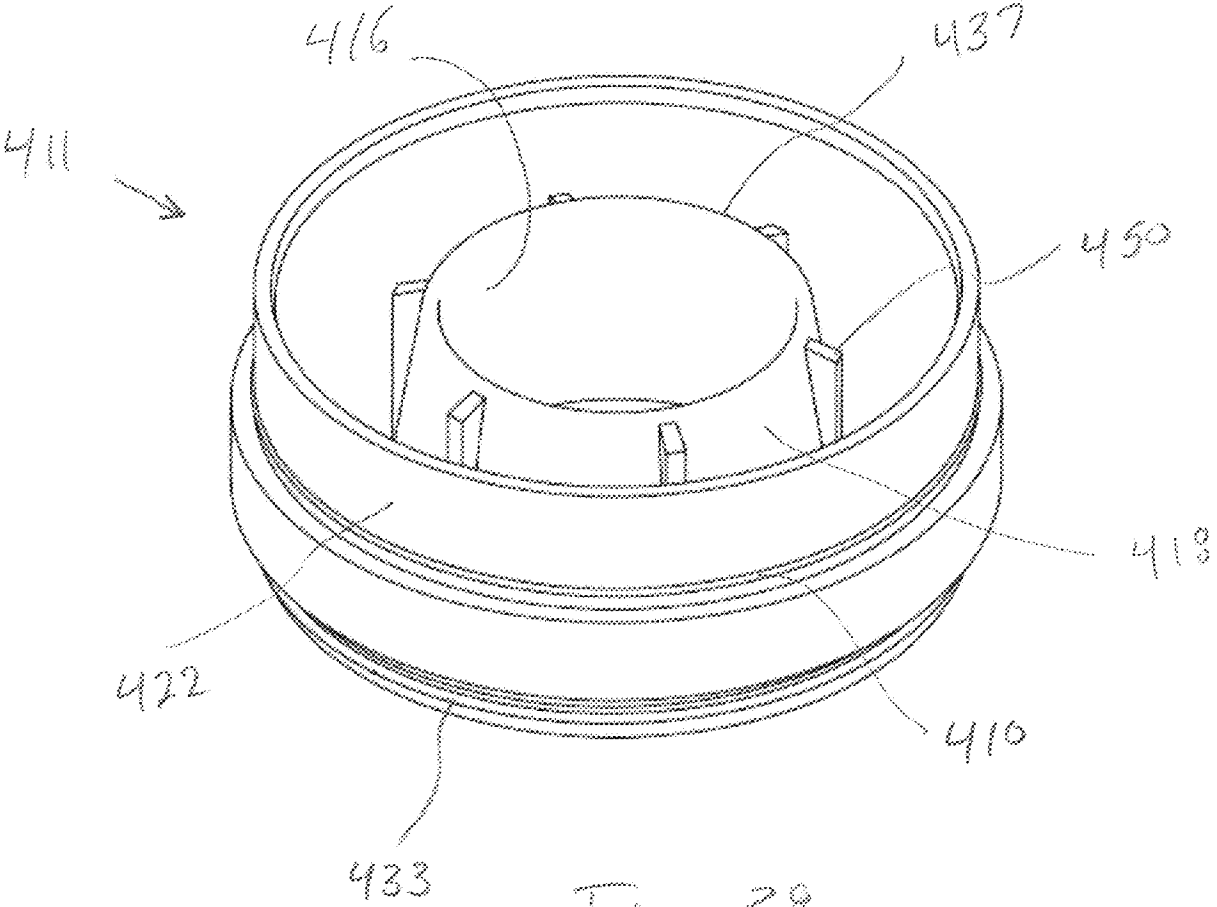
FIG. 38 is an elevational view of a body portion of the container of FIG. 35.

FIG. 38 is perspective view of main body 411 turned upside down from how it is shown in FIG. 36. Frustoconical wall 416 forms the outer side of central well 418 and an inner surface of bead storage chamber 424 (as shown in FIG. 36). One or more blades 450 extend radially outward from wall 416. Cylindrical extension 422 forms a lower part of body 411. Threads 433 along the upper rim of body 411 engage with cap 412 when the container is assembled.

As shown in FIG. 36, cylindrical extension 422 is positioned in the gap between walls 445 and 446 of base 414. Sufficient clearance is provided so that cylindrical extension 422 can rotate within the gap. According to one embodiment, a circumferential ring 410 is provided on an outer surface of extension 422 and a corresponding circumferential groove 412 is provided on the inner surface of wall 445. Ring 410 and groove 412 interlock so that body 411 can be snap fit onto base 414 while allowing the body and base to rotate with respect to one another.

Lower edge 437 of wall 416 on body 411 is separated from annular surface 444 of pan 460 by a small gap. Chamber 424 holds supply of friable beads 445. The beads are composed of material that will be abraded from the beads and delivered to the bottom surface of well 418 when the container is operated. The size of the beads is larger than the gap so the beads are secured in chamber 424. Blades 450 on body 411 are positioned to pass closely to protrusions 452 when the container is operated. When the container is held in the upright position, as shown in FIGS. 36 and 39, beads 44 rest on the surface of pan 460 in and around blades 450 and protrusions 452.

Figure 39:
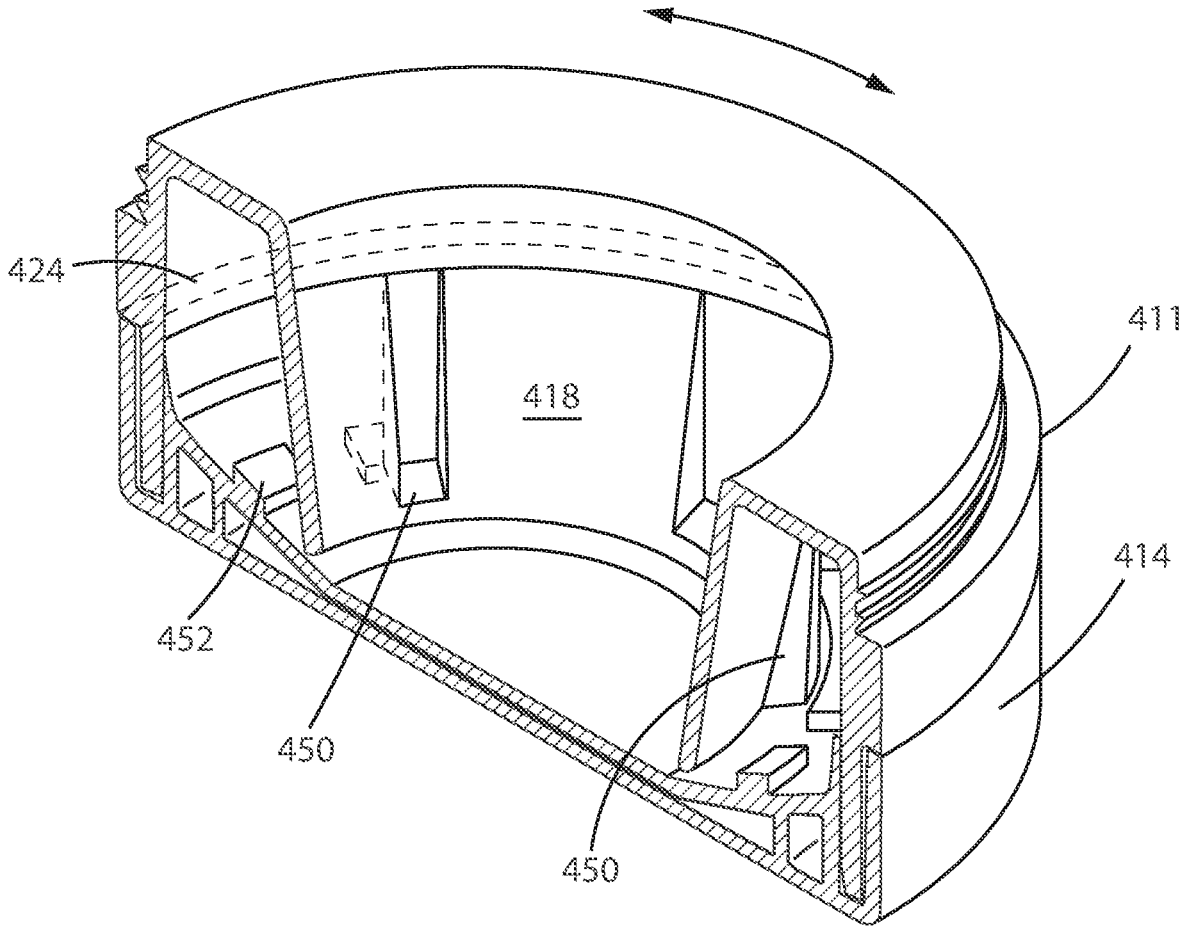
FIG. 39 is a perspective sectional view of the container of FIG. 35.

FIG. 39 shows a perspective view of the assembled container in cross section. Beads are not shown in FIG. 39 for clarity. As indicated by the arrows, main body 411 rotates with respect to base 414. Blades 450 rotate along with body 411 relative to protrusions 452 on the annular region 444 of pan 460. Beads are caught between the edges of protrusions 452 and the blades 450, crushing or abrading some of the beads, dislodging the friable material. The dislodged material flows down the annular portion 466 of the base, through the gap between edge 437 and annular region 444, and onto the bottom surface of well 418. This material can be collected, for example, using a brush B, as shown in FIG. 4. It is to be understood that the invention is not limited to the features and embodiments hereinabove specifically set forth but may be carried out in other ways without departure from its spirit.

What is claimed is:

1. A container for dispensing loose powder, comprising:

(a) a well defining a central upwardly open well volume having a lower end;

(b) a container side wall laterally surrounding the well and defining therewith an upwardly closed powder chamber extending circumferentially around the well and having a lower end;

(c) a bottom member disposed at a lower end of the well and powder chamber and cooperating therewith to close the central well volume and the lower end of the powder chamber, wherein the bottom member and at least a portion of the well are relatively rotatable between a first position in which the well and the bottom member cooperatively prevent passage of powder from the powder chamber to the well, and a second position in which at least one gap opens to permit limited passage of powder from the powder chamber into the lower end of the well volume;

(d) a lid, removably closing the upper end of the well, that can be opened for permitting a manipulable applicator to transport powder from the lower end of the well volume to an application location outside the container; and (e) a bottom cap in which the bottom member is mounted, wherein the bottom cap is disposed at the lower end of the container side wall with the bottom member facing the lower ends of the well volume and the powder chamber and being threaded on the container side wall such that by relative rotation of the bottom cap and the container side wall the bottom member can be moved back and forth between a first position engaging a lower end of the well to prevent passage of powder from the powder chamber into the well volume and a second position spaced from the lower end of the well sufficiently to define said gap therewith.

2. A container as defined in claim 1 wherein the powder chamber contains a quantity of loose powder to be dispensed.

3. A container as defined in claim 1, further comprising a filling port through an upper surface of the powder chamber, wherein the port is adapted to admit the powder into the chamber, and a plug shaped to close the filling port.

4. A container as defined in claim 3, further comprising a filling funnel shaped to engage the filing port and adapted to direct the powder through the port.

5. A container as defined in claim 1, wherein the well and the container side wall are connected together to close an upper end of the powder chamber, and wherein the bottom cap is initially separate from the container side wall such that the lower end of the powder chamber is open for filling with powder when the container side wall is inverted.

6. A container as defined in claim 5, wherein the bottom cap and the container side wall bear interfering surfaces permitting initial screwing of the bottom cap to mount the bottom cap on the container side wall at said first position but preventing subsequent oppositely directed unscrewing of the bottom cap from the container side wall beyond said second position.

7. A method of filling a container as defined in claim 6 with loose powder, comprising the steps of inverting the container before the bottom cap is mounted thereon such that the lower end of the powder chamber is open and faces upwardly; delivering loose powder into the powder chamber through the upwardly facing open lower end thereof while preventing delivery of loose powder into the well volume; and thereafter threading the bottom cap onto the container side wall until the bottom cap reaches the aforesaid first position.

* * * * *